US008929761B2

(12) United States Patent
Wakide et al.

(10) Patent No.: US 8,929,761 B2
(45) Date of Patent: Jan. 6, 2015

(54) IMAGE FORMING METHOD AND APPARATUS HAVING INDUCTION HEAT FIXING DEVICE WITH TEMPERATURE SENSING OF SWITCHING ELEMENT

(75) Inventors: Hitoshi Wakide, Toyokawa (JP); Atsushi Yamaguchi, Tahara (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 374 days.

(21) Appl. No.: 13/448,667

(22) Filed: Apr. 17, 2012

(65) Prior Publication Data

US 2012/0269533 A1 Oct. 25, 2012

(30) Foreign Application Priority Data

Apr. 20, 2011 (JP) ..... 2011-094422

(51) Int. Cl.
*G03G 15/20* (2006.01)
*H05B 6/06* (2006.01)

(52) U.S. Cl.
USPC ..... 399/69; 219/216; 219/663

(58) Field of Classification Search
CPC ..... G03G 15/2039; G03G 15/205; G03G 15/2078; H05B 3/0095; H05B 6/145; H05B 6/06
USPC ..... 399/69, 70, 328, 330, 335; 219/216, 219/619, 661, 663
See application file for complete search history.

(56) References Cited

U.S. PATENT DOCUMENTS

| | | | | |
|---|---|---|---|---|
| 6,321,046 | B1 * | 11/2001 | Kikuchi et al. | 399/69 |
| 6,438,335 | B1 | 8/2002 | Kinouchi et al. | |
| 7,106,988 | B2 * | 9/2006 | Nakaya | 399/70 |
| 7,442,907 | B2 * | 10/2008 | Miyauchi et al. | 219/661 |
| 8,456,220 | B2 * | 6/2013 | Thome et al. | 327/513 |
| 8,644,722 | B2 * | 2/2014 | Yoda et al. | 399/70 |
| 2004/0136754 | A1 | 7/2004 | Yamamoto et al. | |

FOREIGN PATENT DOCUMENTS

| | | |
|---|---|---|
| JP | 05-074564 | 3/1993 |
| JP | 2001-092298 | 4/2001 |
| JP | 2002-278350 | 9/2002 |
| JP | 2003202772 A * | 7/2003 |

(Continued)

OTHER PUBLICATIONS

Official Action issued in corresponding Japanese Patent Application No. 2011-094422, mailed May 28, 2013, and English translation.

*Primary Examiner* — Robert Beatty
(74) *Attorney, Agent, or Firm* — Buchanan Ingersoll & Rooney PC

(57) ABSTRACT

An image forming apparatus uses a switching element to switch current flowing to an excitation coil, so that a heating layer in a fixing member produces heat that fixes an image to a transported sheet. Based on a change in temperature of the switching element over time, a prediction unit determines, at a predetermined first time point, a predicted temperature of the switching element at a second time point at which a tip of the sheet is scheduled to arrive at the fixing member. When the predicted temperature is at least a predetermined value, a control unit controls power supplied to the excitation coil by restricting switching of the switching element and lifting the restriction, so that by the second time point the detected temperature of the fixing member reaches a temperature necessary for fixing.

20 Claims, 24 Drawing Sheets

(56) References Cited

FOREIGN PATENT DOCUMENTS

| | | | | |
|---|---|---|---|---|
| JP | 2004021174 | A | * | 1/2004 |
| JP | 2004-151462 | | | 5/2004 |
| JP | 2004-156589 | | | 6/2004 |
| JP | 2004361796 | A | * | 12/2004 |
| JP | 2005-257898 | A | | 9/2005 |
| JP | 2006-268680 | | | 10/2006 |

* cited by examiner

FIG. 6A Predicted temperature Tsp of switching element < 80° C
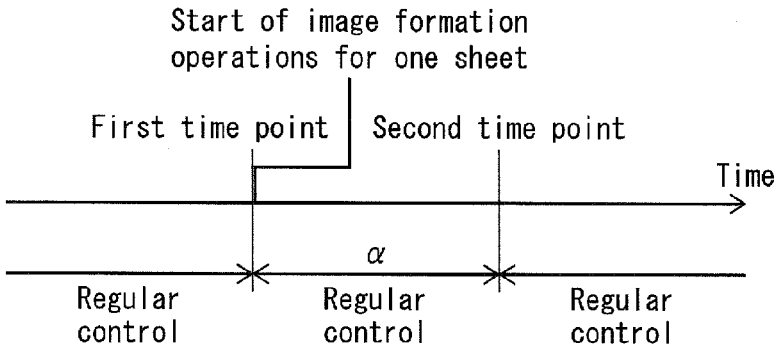
FIG. 6B 80°C ≤ Tsp < 100°C
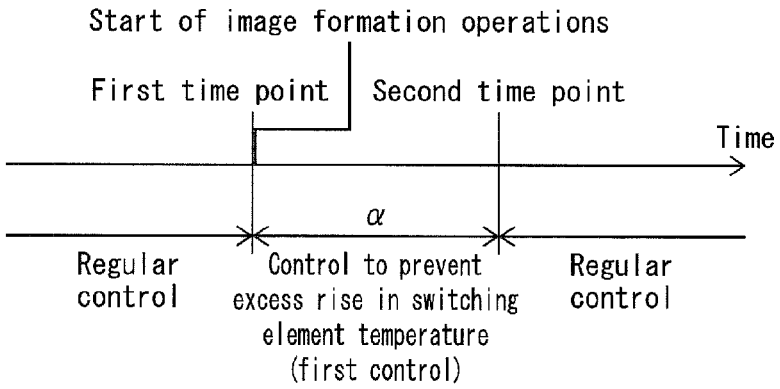
FIG. 6C Tsp ≥ 100°C
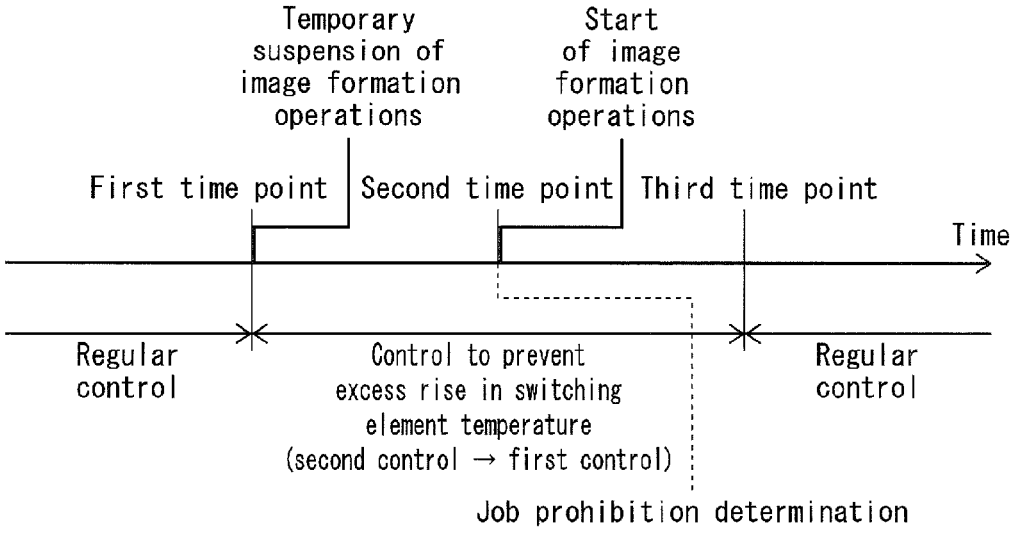

FIG. 9

62

| Time | SW element temperature | Specified power |
|---|---|---|
| t1 | T1 | P1 |
| t2<br>·<br>· | T2<br>·<br>· | P2<br>·<br>· |
| tn | Tn | Pn |

FIG. 10

64

| Mode | Prediction point |
|---|---|
| Color | Immediately before start of Y-color exposure |
| Monochrome (K color) | Immediately before start of transportation |

FIG. 18

66

| Surrounding temperature | ΣPB1、ΣPB2 | ΔA | Predicted temperature Tsp of SW element |
|---|---|---|---|
| ~20℃ | ΣPB1<ΣPB2 | ΔA>0 | TmpC |
| | | ΔA=0 | |
| | | ΔA<0 | |
| | ΣPB1=ΣPB2 | ΔA>0 | |
| | | ΔA=0 | |
| | | ΔA<0 | Smallest value |
| | ΣPB1>ΣPB2 | ΔA>0 | TmpC |
| | | ΔA=0 | Smallest value |
| | | ΔA<0 | |
| 20℃~30℃ | ΣPB1<ΣPB2 | ΔA>0 | TmpC |
| | | ΔA=0 | |
| | | ΔA<0 | |
| | ΣPB1=ΣPB2 | ΔA>0 | |
| | | ΔA=0 | |
| | | ΔA<0 | |
| | ΣPB1>ΣPB2 | ΔA>0 | |
| | | ΔA=0 | |
| | | ΔA<0 | |
| 30℃~ | ΣPB1<ΣPB2 | ΔA>0 | Largest value |
| | | ΔA=0 | |
| | | ΔA<0 | TmpC |
| | ΣPB1=ΣPB2 | ΔA>0 | Largest value |
| | | ΔA=0 | TmpC |
| | | ΔA<0 | |
| | ΣPB1>ΣPB2 | ΔA>0 | Largest value |
| | | ΔA=0 | TmpC |
| | | ΔA<0 | |

IMAGE FORMING METHOD AND APPARATUS HAVING INDUCTION HEAT FIXING DEVICE WITH TEMPERATURE SENSING OF SWITCHING ELEMENT

CROSS-REFERENCE TO RELATED APPLICATIONS

This application is based on applications No. 2011-94422 filed in Japan, the contents of which are hereby incorporated by reference.

TECHNICAL FIELD

The present invention relates to an image forming apparatus and an image forming method in which an electromagnetic induction heating layer provided on a fixing member is heated with magnetic flux from an excitation coil and an unfixed image is fixed on a transported sheet with heat from the fixing member.

BACKGROUND ART

In the field of image forming apparatuses, such as printers, the adoption of fixing units based on electromagnetic induction heating has been proposed. In a fixing unit based on electromagnetic induction heating, a fixing member, such as a fixing roller and a fixing belt, is provided with an electromagnetic induction heating layer. An excitation coil is caused to produce magnetic flux by switching the current flowing to the excitation coil via a switching element. The magnetic flux then causes the electromagnetic induction heating layer to heat up, so that the unfixed image on the transported sheet is fixed by the heat of the fixing member.

During such electromagnetic induction heating, the on (conduction) and off (cutoff) switching cycle of the switching element is controlled so as to maintain the temperature of the fixing member within a range of a few ° C. of the necessary temperature for during image formation operations, such as 180° C.

The switching cycle varies due to fluctuations in the temperature of the fixing member and the voltage input into the excitation coil. For example, the ratio of the on time to the off time (duty ratio) is raised when the temperature of the fixing member drops, or when the voltage input into the excitation coil drops. When the duty ratio is raised, the current flowing through the switching element increases, resulting in the switching element heating up. If the temperature of the switching element rises too high, the switching element may deteriorate or be damaged.

Japanese Patent Application Publication No. 2005-257898 discloses technology to prevent such deterioration of the switching element as follows. The temperature of both the fixing roller and the switching element is detected. While conduction of the switching element is controlled based on the detected temperature of the fixing roller, the current supplied to the switching element is reduced when the detected temperature of the switching element exceeds a predetermined value, so that the temperature of the switching element will not rise too high.

With the structure described in the above-cited publication, however, when the detected temperature of the switching element becomes higher than the predetermined value, the current supplied to the switching element is maintained at a reduced level until the detected temperature of the switching element falls to the predetermined value or less.

As a result, if the detected temperature of the switching element is higher than the predetermined value during a period from the start of image formation operations for a sheet until the tip of the sheet arrives at the fixing member, the current provided to the switching element will be reduced at the same time as the image formation operations for the sheet are performed.

If the temperature of the switching element does not fall to the predetermined temperature or lower by the time the tip of the sheet reaches the fixing member, the reduction in current provided to the switching element will continue, and the temperature of the fixing member will continue to drop. This easily leads to a situation in which, at the time when the tip of the sheet reaches the fixing member, the temperature of the fixing member is below the temperature necessary for fixing. If fixing is performed in this state, fixity will deteriorate, leading to defective fixing.

SUMMARY OF INVENTION

The present invention has been conceived in light of the above problems, and it is an object thereof to provide an image forming apparatus and an image forming method that perform fixing based on electromagnetic induction heating and that prevent an excessive rise in temperature of the switching element while suppressing a reduction in fixity.

In order to achieve the above object, an aspect of the present invention is an image forming apparatus that uses a switching element to switch current flowing to an excitation coil, so that the excitation coil generates magnetic flux that causes an electromagnetic induction heating layer in a fixing member to produce heat, the heat fixing an unfixed image formed on a transported sheet to the transported sheet, the image forming apparatus comprising: a detection unit configured to detect a temperature of the fixing member; a calculation unit configured to calculate a change in temperature of the switching element over time; a prediction unit configured to determine, at a first time point, a predicted temperature of the switching element at a second time point in accordance with the change in temperature of the switching element up until the first time point, the first time point being a predetermined time before the second time point, and the second time point being a time at which a tip of the sheet in a direction of transportation is scheduled to arrive at the fixing member; and a control unit configured to perform first control, from the first time point until the second time point, when the predicted temperature of the switching element is at least a predetermined value, the first control controlling power supplied to the excitation coil by restricting switching of the switching element and lifting the restriction, so that by the second time point the detected temperature of the fixing member reaches a temperature necessary for fixing.

BRIEF DESCRIPTION OF DRAWINGS

These and the other objects, advantages and features of the invention will become apparent from the following description thereof taken in conjunction with the accompanying drawings which illustrate a specific embodiment of the invention.

In the drawings:

FIGS. 6A through 6C are conceptual diagrams illustrating switching between regular control and control to prevent an excess rise in switching element temperature.

FIG. 9 shows an example of the content of a corresponding information table.

FIG. 10 shows an example of the content of a prediction point table.

FIG. 18 shows the content of a temperature prediction determination table.

DESCRIPTION OF EMBODIMENTS

The following describes an embodiment of an image forming apparatus according to the present invention, using a tandem-type color digital printer (hereinafter simply referred to as "printer") as an example.

(1) Overall Configuration of Printer

Figure 1:
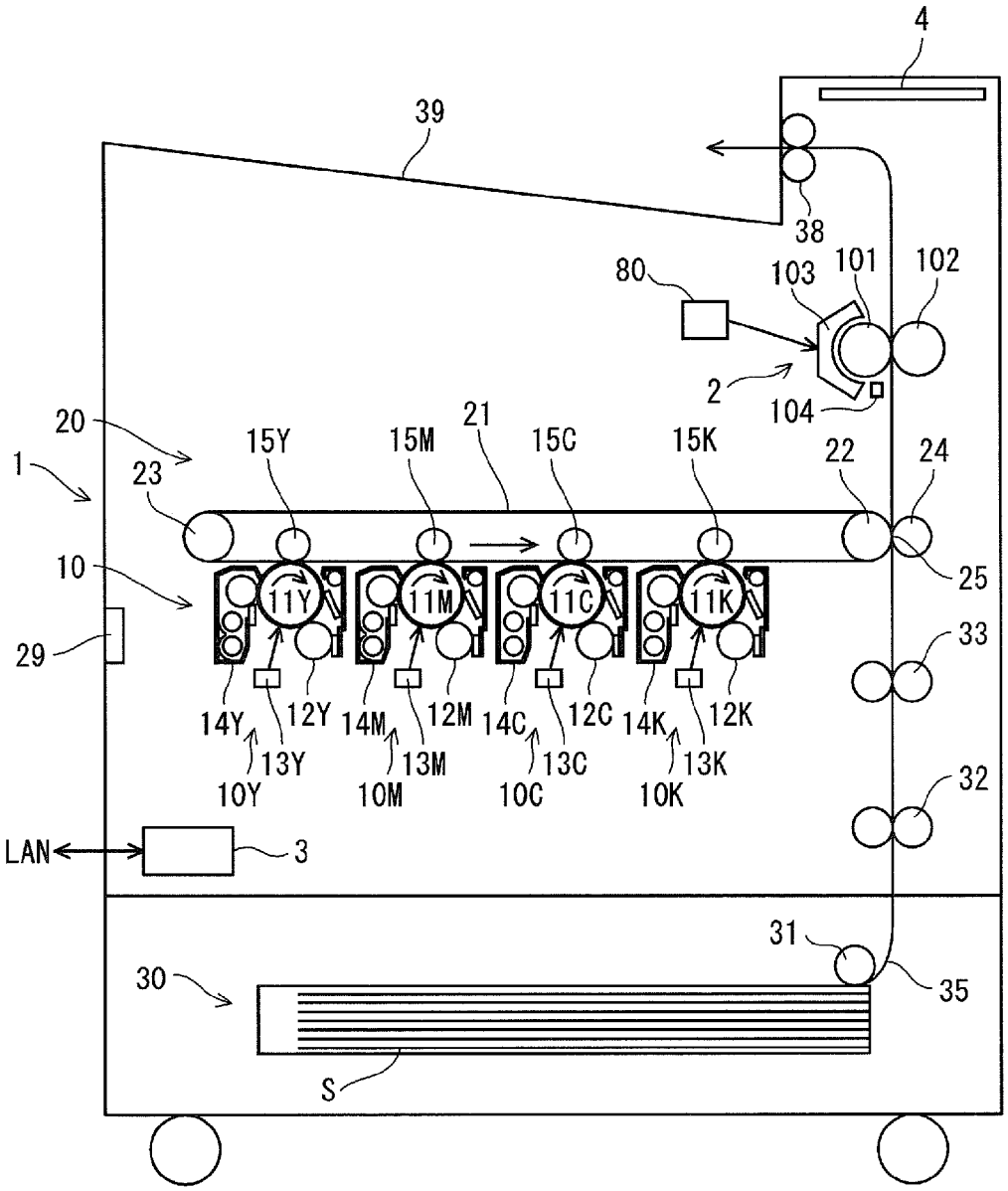
FIG. 1 shows the overall structure of a printer.

FIG. 1 shows the overall structure of the printer.

As shown in FIG. 1, the printer fauns images through well-known electrophotography. The printer is provided with a print unit 1, a fixing unit 2, a control unit 3, an operation panel 4, and the like. The printer is connected to a network (such as a LAN) and, based upon an instruction to execute a print job received from an external terminal (not shown in the figures), can switch between forming a color image using yellow (Y), magenta (M), cyan (C), and black (K) and forming a monochrome image using black (K).

The print unit 1 is provided with an image creating unit 10, an intermediate transfer unit 20, and a feed unit 30.

The image creating unit 10 is provided with imaging units 10Y through 10K, corresponding to the colors Y through K. The imaging unit 10Y is provided with a photoconductor drum 11Y and, disposed around the photoconductor drum 11Y, a charger 12Y, an exposure unit 13Y, a developer 14Y, a first transfer roller 15Y, a cleaner for cleaning the photoconductor drum 11Y, and the like. A Y-color toner image is formed on the photoconductor drum 11Y after completing well-known charging, exposure, and developing processes. The other imaging units 10M through 10K have a similar structure, and toner images of corresponding colors are formed on the photoconductor drums 11M through 11K.

The intermediate transfer unit 20 is provided with an intermediate transfer belt 21 that rotates in the direction of the arrow, a drive roller 22 and a passive roller 23 that maintain the intermediate transfer belt 21 taut, and a secondary transfer roller 24 that is provided opposite the drive roller 22, with the intermediate transfer belt 21 therebetween, and that presses against the driver roller 22.

The feed unit 30 is provided with a pickup roller 31, a pair of transport rollers 32, and a pair of resist rollers 33. The pickup roller 31 feeds one sheet at a time of paper S, which is a recording sheet, from a paper cassette along a conveyance path 35. The pair of transport rollers 32 transport the sheet S fed along the conveyance path 35 by the pickup roller 31. The pair of resist rollers 33 set the timing at which to send the sheet S, transported along the conveyance path 35 by the pair of transport rollers 32, to the secondary transfer roller 24.

The fixing unit 2 is based on electromagnetic induction heating and is provided with a fixing roller 101, a pressing roller 102, and the like. Details on the structure of the fixing unit 2 are provided below.

During color image formation operations, the control unit 3 converts an image signal from an external terminal to digital signals for the colors Y through K and generates drive signals for driving the laser diode in the exposure units 13Y through 13K of the imaging units 10Y through 10K. In response to the generated drive signals, the laser diode of each of the exposure units 13Y through 13K of the imaging units 10Y through 10K is driven to emit laser light, thus scanning the photoconductor drums 11Y through 11K.

Before being scanned, the photoconductor drums 11Y through 11K in the imaging units 10Y through 10K are uniformly charged by the chargers 12Y through 12K. Exposure to laser light forms, on the photoconductor drums 11Y through 11K, an electrostatic latent image corresponding to the image to be formed. The electrostatic latent images thus formed are developed with toner by the developers 14Y through 14K.

The toner image of each color is acted on by an electrostatic force from the electrical field produced between the first transfer rollers 15Y through 15K and the respective photoconductor drums 11Y through 11K and undergoes primary transfer to the intermediate transfer belt 21. The timing of this image creation for each color is shifted so that the toner images are overlapped on the same position along the intermediate transfer belt 21. The various color toner images transferred by superimposition onto the intermediate transfer belt 21 are transported by rotation of the intermediate transfer belt 21 to a secondary transfer position 25, a position at which the secondary transfer roller 24 presses against the intermediate transfer belt 21.

In coordination with the timing of the above image creation operations, the feed unit 30 feeds a sheet S via the pair of resist rollers 33. The sheet S is transported while sandwiched between the rotating intermediate transfer belt 21 and the secondary transfer roller 24. The sheet S is acted on by an electrostatic force from the electrical field produced by secondary transfer voltage provided to the secondary transfer roller 24 so that, at the second transfer position 25, the various color toner images on the intermediate transfer belt 21 simultaneously undergo secondary transfer to the sheet S.

The sheet S, having passed through the second transfer position 25, is transported to the fixing unit 2. Upon passing through the fixing unit 2, the toner images are fixed to the sheet S by heating and pressure. The sheet S is then ejected outside of the printer by a pair of ejection rollers 38 and is stored in a storage tray 39.

The above described an example of a color mode (first image formation mode) for forming a color image. In the case of a monochrome mode (second image formation mode) for forming an image with only the color K, only the image K-color creating unit 10K is driven to form a K-color toner image, which undergoes secondary transfer to the sheet S and is then fixed thereon.

The operation panel 4, which is an operation unit, is provided on the front of the apparatus at a position easy for the user to operate. The operation panel 4 is provided with keys for receiving input from the user, such as a mode selection key for choosing between color mode and monochrome mode. By operating the mode selection key, the user can select a desired mode, i.e. color or monochrome, for each print job.

The printer may also be configured so that when information indicating whether the print job should be performed in color or monochrome is included in the print job data from an external terminal, the printer switches modes to perform the job in the indicated mode.

A liquid crystal display including a touch panel is provided in the operation panel 4. The liquid crystal display both displays a variety of messages for the user and receives touch input from the user indicating a variety of instructions and selections. The messages are displayed in accordance with instructions from the control unit 3. The information input by the user by touch is transferred to the control unit 3.

A surrounding temperature sensor 29 is provided in the print unit 1 to detect the temperature (environmental temperature) around the apparatus. The surrounding temperature sensor 29 transmits a surrounding temperature detection signal to the control unit 3.

(2) Structure of Fixing Unit 2

Figure 2A:
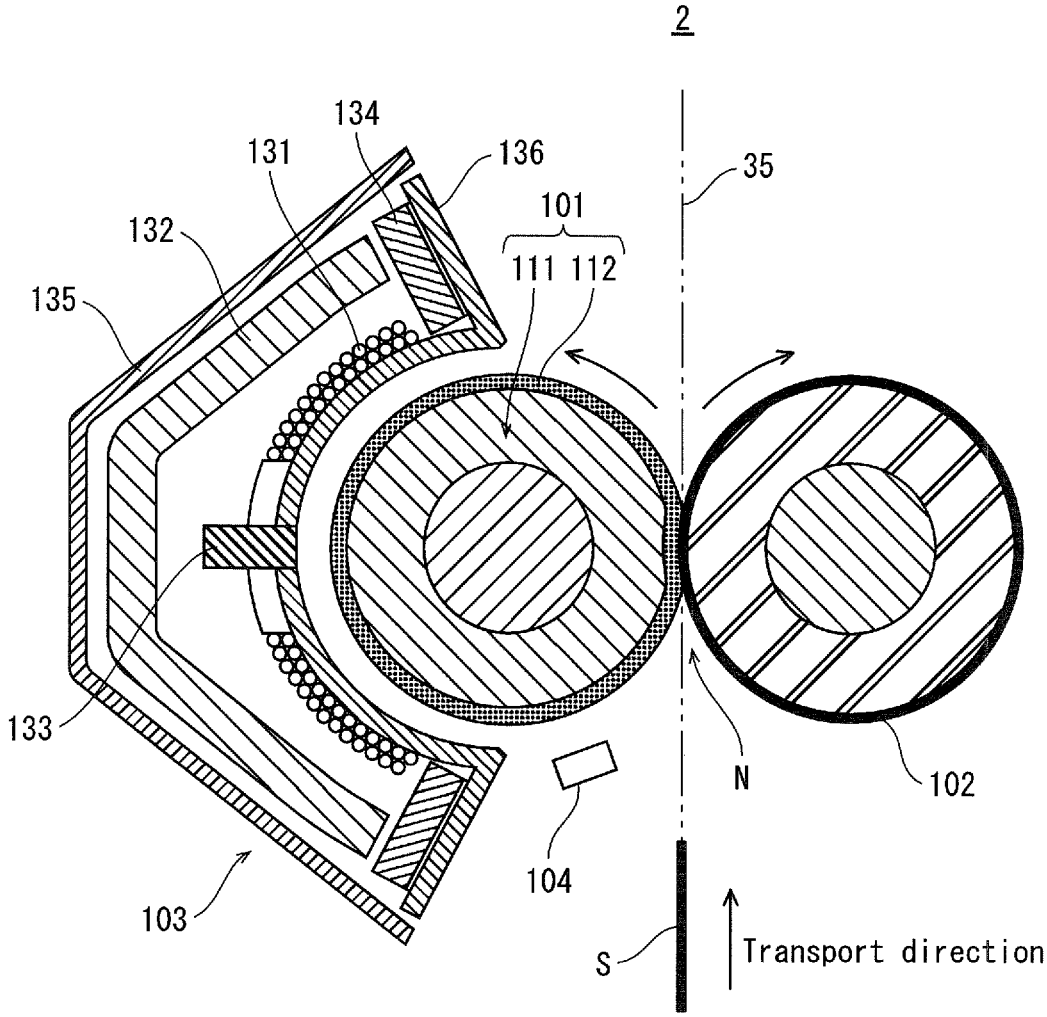
FIG. 2A is a lateral cross-section diagram showing the structure of a fixing unit.
Figure 2B:
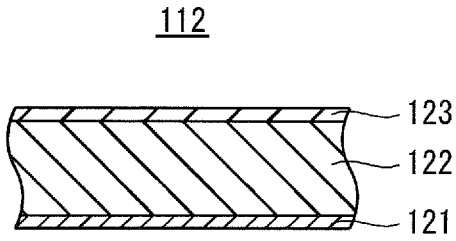
FIG. 2B is a cross-section diagram showing the structure of a sleeve provided on the fixing roller.

FIG. 2A is a lateral cross-section diagram showing the structure of the fixing unit 2, and FIG. 2B is a cross-section diagram showing the structure of a sleeve 112 provided on the fixing roller 101.

As shown in these figures, the fixing unit 2 is provided with a fixing roller 101, a pressing roller 102, a magnetic flux generator 103, a roller temperature sensor 104, and the like.

The fixing roller 101 is formed by a roller body 111 and the sleeve 112 closely attached to the outer circumferential surface of the roller body 111.

The roller body 111 is formed from a metal core, which is an elongated, cylindrical shaft member, and a heat insulating layer formed around the metal core. The heat insulating layer is a sponge or the like made from rubber or resin.

As shown in FIG. 2B, the sleeve 112 is formed by an electromagnetic induction heating layer 121, an elastic layer 122, and a releasing layer 123 layered in this order on the roller body 111.

The electromagnetic induction heating layer 121 is formed from nickel or the like and heats up due to magnetic flux produced by the magnetic flux generator 103. Note that the material for the electromagnetic induction heating layer 121 is not limited to nickel. As long as the material heats up due to electromagnetic induction, another material such as aluminum or copper may be used.

The elastic layer 122 is an elastic member formed from silicon rubber or the like and serves to improve adhesion between the sheet S and the surface of the fixing roller 101.

The releasing layer 123, which is the outermost layer, is formed from tetrafluoroethylene perfluoroalkoxy vinyl ether copolymer (PFA) or the like and serves to improve the releasability of the surface of the fixing roller 101 with respect to the sheet S.

The pressing roller 102 is formed from an elongated, cylindrical metal core of aluminum or the like and a releasing layer formed from PFA or the like layered around the metal core with an elastic layer of silicon sponge rubber or the like therebetween. A biasing means, not shown in the figures, that includes a spring and the like presses the pressing roller 102 against the fixing roller 101 so that a fixing nip N is formed between the pressing roller 102 and the fixing roller 101.

The fixing roller 101 and the pressing roller 102 are rotatably supported at either end in the shaft direction (hereinafter, "roller shaft direction") by bearings or the like in a frame (not shown in the figures). The pressing roller 102 is driven by a driving motor (not shown in the figures) to rotate in the direction shown by the corresponding arrow in FIG. 2A. As a result of rotation of the pressing roller 102, the fixing roller 101 is caused to rotate in the direction of the corresponding arrow in FIG. 2A.

The magnetic flux generator 103 includes an excitation coil 131, main cores 132, a central core 133, sub-cores 134, a cover 135, and a coil bobbin 136. The magnetic flux generator 103 is disposed along the roller shaft direction of the fixing roller 101 so as to face the fixing roller 101.

The coil bobbin 136 is a plate member that includes a portion curved in an arc along the surface of the fixing roller 101. Each end of the coil bobbin 136 in the roller shaft direction is fixed by a frame or the like not shown in the figures. The position of the coil bobbin 136 is adjusted so that the gap between the coil bobbin 136 and the surface of the fixing roller 101 is a predetermined distance. The main cores 132, the central core 133, and the sub-cores 134 are formed from ferrite, which has a high magnetic permeability, or the like and are provided on the surface of the coil bobbin 136 opposite the surface facing the fixing roller 101.

The excitation coil 131 is elongated in the roller shaft direction, and conducting wires are wound around the coil bobbin 136 so that a lateral cross-section is arc-shaped. The excitation coil 131 is connected to an IH power supply drive unit 80 (FIG. 1) that includes a high-frequency inverter circuit. By receiving power from the IH power supply drive unit 80, the excitation coil 131 generates magnetic flux for heating the electromagnetic induction heating layer 121 of the fixing roller 101.

The magnetic flux generated by the excitation coil 131 is conducted to the fixing roller 101 by the main cores 132 through the sub-cores 134, penetrates into the electromagnetic induction heating layer 121 of the fixing roller 101, and causes eddy current in the electromagnetic induction heating layer 121 so that the electromagnetic induction heating layer 121 heats up.

The heat of the electromagnetic induction heating layer 121 transfers to the pressing roller 102 at the fixing nip N, so that the region of the fixing nip N increases in temperature.

The roller temperature sensor 104 is located at the outer periphery of the fixing roller 101 at a position downstream from the magnetic flux generator 103 and upstream from the fixing nip N in the rotational direction of the fixing roller 101. In this embodiment, the roller temperature sensor 104 is formed by a device that detects the surface temperature of the fixing roller 101 without coming into contact with the fixing roller 101. Note that a different structure for detecting the surface temperature of the fixing roller 101, such as a thermistor in contact with the surface of the fixing roller 101, may be used. A corresponding detection signal is transmitted to the control unit 3.

(3) Structure of Control Unit 3

Figure 3:
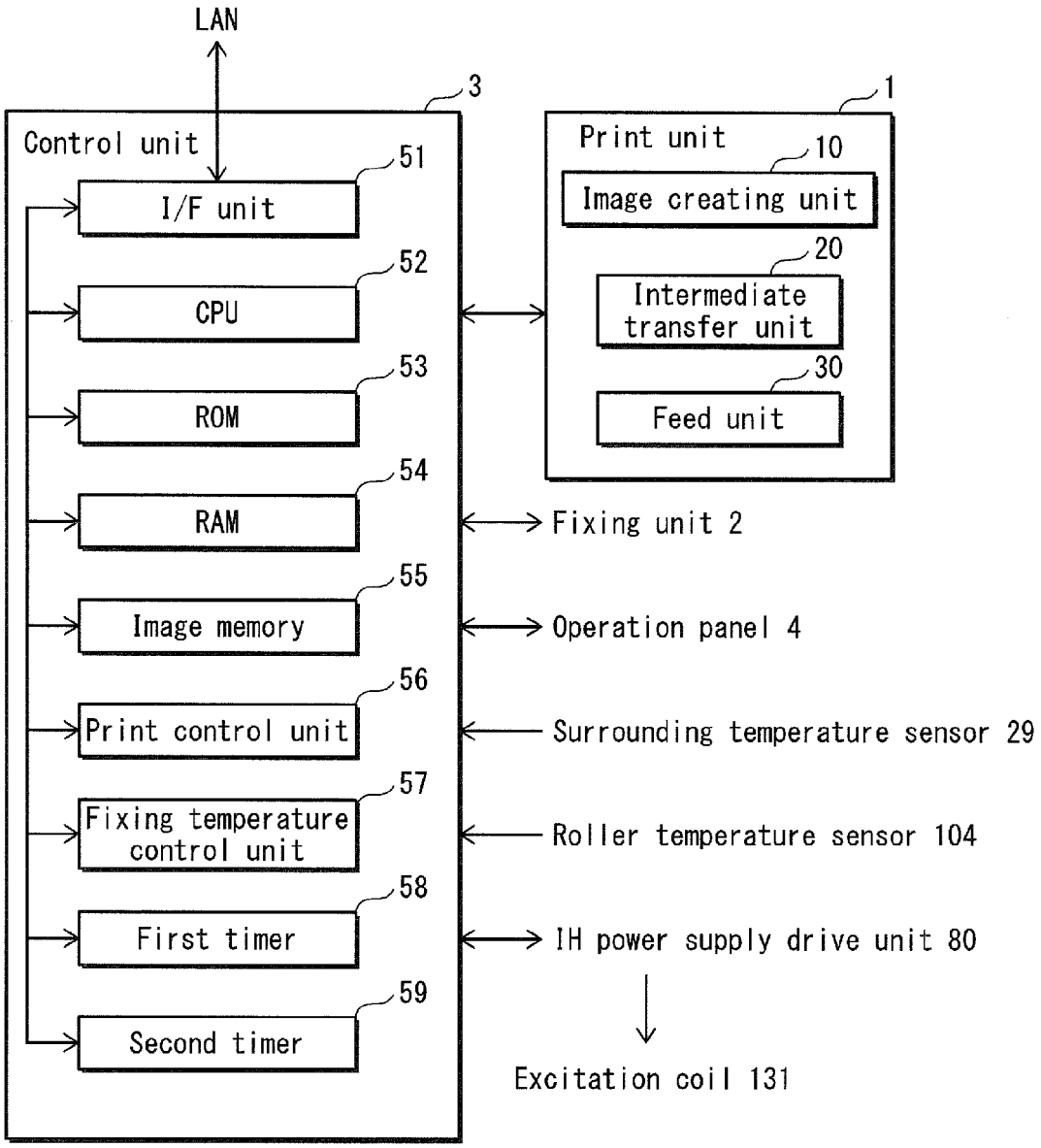
FIG. 3 is a block diagram showing the structure of a control unit.

FIG. 3 is a block diagram showing the structure of the control unit 3.

As shown in FIG. 3, the main components provided in the control unit 3 are a communication interface (I/F) 51, a CPU 52, a ROM 53, a RAM 54, an image memory 55, a print control unit 56, a fixing temperature control unit 57, a first timer 58, a second timer 59, and the like. These components are configured to exchange signals and data.

The communication I/F 51 is an interface for connecting to a network, in this case a LAN, and is specifically a LAN card or LAN board. The communication I/F 51 receives data for a print job transmitted over the LAN from an external terminal and stores the data in the image memory 55.

The print control unit 56 controls the print unit 1 in response to instructions from the CPU 52 to perform color and monochrome print jobs based on the print job data stored in the image memory 55.

The fixing temperature control unit 57 controls the fixing temperature of the fixing roller 101. Specifically, the fixing temperature control unit 57 receives the detection signal from the roller temperature sensor 104, identifies the current temperature (measured value) of the fixing roller 101 and instructs the IH power supply drive unit 80 to supply power to the excitation coil 131 so that the surface temperature of the fixing roller 101 (hereinafter referred to as the "fixing roller temperature") falls within a temperature range necessary for fixing, such as plus or minus 5° C. of a standard temperature of 180° C., i.e. 175° C.-185° C.

In more detail, suppose fixing roller temperatures can be expressed, for example, by the relationships $T1<T2<\ldots<Tn$, and that the power supplied to the excitation coil 131 (power supplied to the coil) can be expressed by the relationships $W1>W2>\ldots>Wn$. By associating the fixing roller temperature at T1 with power supplied to the coil W1, T2 with W2, . . . , and Tn with Wn, the fixing temperature control unit 57 issues instructions for each detected temperature to increase the power supplied to the coil when the fixing roller temperature is low and to lower the power supplied to the coil when the fixing roller temperature is high. This control is referred to hereinafter as regular control.

The relationship between the fixing roller temperature and the power supplied to the coil is determined in advance by experiment or other means and is stored in the ROM 53. The power supplied to the coil is set in advance for a fixing roller temperature and is referred to as a "power setting".

The fixing roller temperature is detected at predetermined intervals, such as every few milliseconds. Each time the fixing roller temperature is detected in a predetermined interval, the power setting for the detected fixing roller temperature is read and indicated to the IH power supply drive unit 80.

Each time the power setting is indicated in the predetermined interval, the IH power supply drive unit 80 performs control so that power with the same magnitude as the power setting is provided to the excitation coil 131.

The fixing temperature control unit 57 performs temperature control switching processing. While details on temperature control switching processing are provided below, the following is a rough outline.

(a) At a first time point immediately (a few milliseconds) before the start of image formation operations by the print unit 1 for one sheet S, the temperature of the switching element 86 at a second time point (time targeted for prediction) is predicted. The second time point is the predicted time of arrival at the fixing nip N of the tip of the sheet S in the transport direction, assuming that image formation operations begin at the first time point.

(b) If the predicted temperature of the switching element 86 is less than a first temperature (for example, 80° C.), regular control is performed. This first temperature corresponds to a temperature above which it is assumed that the switching element 86 will degrade more easily.

(c) If the predicted temperature of the switching element 86 is at least the first temperature, control to prevent an excess rise in switching element temperature is performed. The control to prevent an excess rise in switching element temperature is control to prevent an excess rise in the temperature of the switching element 86 of the IH power supply drive unit 80 (FIG. 7) and includes first control and second control.

The first control is performed when the predicted temperature of the switching element 86 is at least the first temperature and less than a second temperature (for example, 100° C.). The second control is performed when the predicted temperature of the switching element 86 is at least the second temperature. The second temperature is higher than the first temperature and corresponds to a temperature above which it is assumed that the switching element 86 will be damaged. This is set as the upper limit of the temperature of the switching element 86.

(d) During the first control, switching of the switching element 86 is restricted between the first time point and the second time point, in parallel with image formation operations, by indicating power settings to the IH power supply drive unit 80 so that subsequently, at the second time point, when the tip of the sheet S reaches the fixing nip N, the fixing roller temperature will have risen to a standard temperature range.

(e) During the second control, the start of image formation operations is temporarily suspended. Subsequently, when the temperature of the switching element 86 falls below the second temperature, the image formation operations are resumed while performing the same control as in (d). If the temperature of the switching element 86 does not fall below the second temperature, performance of the job is prohibited.

Figure 4A:
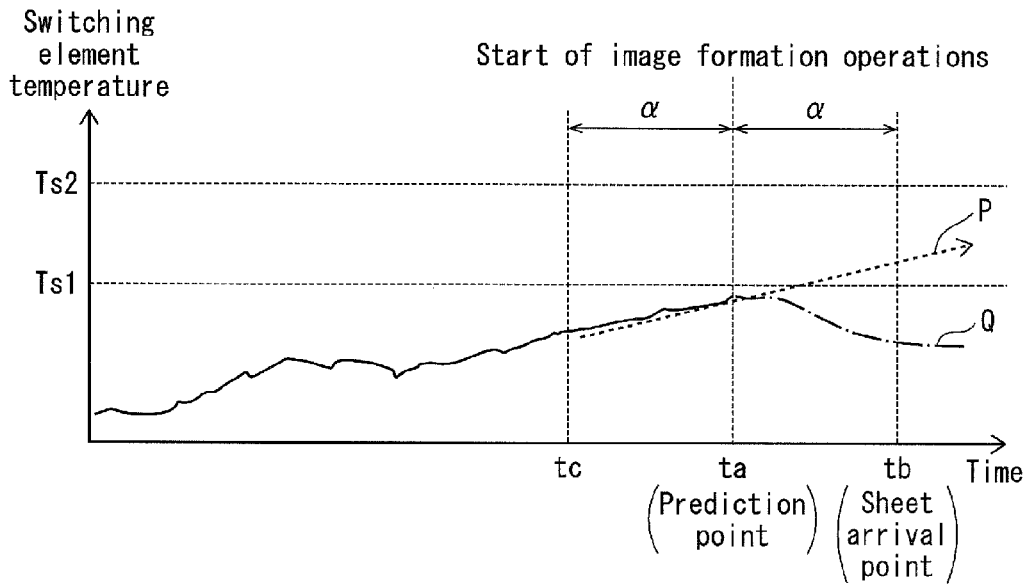
FIG. 4A shows an example of temperature changes in a switching element during first control.
Figure 4B:
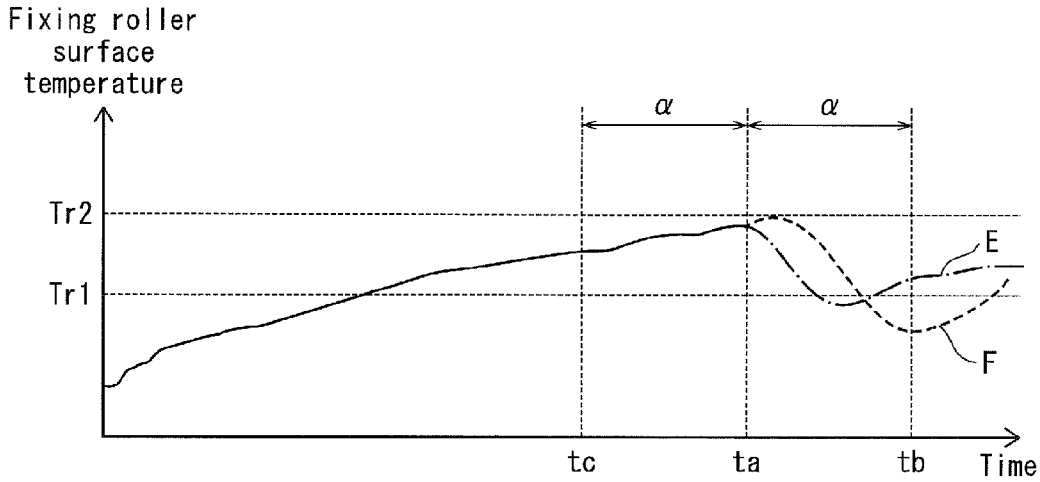
FIG. 4B shows an example of changes in fixing roller surface temperature.

FIG. 4A shows an example of temperature changes in the switching element 86 during first control, and FIG. 4B shows an example of changes in fixing roller surface temperature.

In FIG. 4A, a time point ta (prediction point) indicates the first time point, and a time point tb (sheet arrival point) indicates the second time point.

A time $\alpha$ from the first time point to the second time point indicates the time necessary, from the start of image formation operations for one sheet S, for the tip of the sheet S to reach the fixing nip N. A time point tc indicates the time point that is earlier than the time point ta by the time $\alpha$.

Note that there is an interval of a few milliseconds between the starting time of image formation operations for a sheet S and the first time point, which occurs immediately before the starting time. Therefore, when examined microscopically, the time $\alpha$ should be shortened by this interval of a few milliseconds. This interval has no actual effect, however, on the fixing temperature control. In the example shown in FIGS. 4A and 4B, this interval of a few milliseconds is thus treated as being zero seconds when defining α, and the first time point and the starting time of image formation operations are shown as being synchronous. The same is true for other figures as well.

In FIG. 4A, the temperature Ts1 indicates the first temperature and the temperature Ts2 indicates the second temperature. In FIG. 4B, the temperature Tr1 indicates the lower limit of the temperature necessary for fixing (in the above example, 175° C.), and the temperature Tr2 indicates the upper limit of the temperature necessary for fixing (in the above example, 185° C.). The range from temperature Tr1 to temperature Tr2 corresponds to the temperature range necessary for fixing. FIGS. 4A and 4B show examples in which the temperature of the switching element 86 and the fixing roller temperature tend to rise over time until the time point ta.

This sort of tendency to rise is often caused by factors such as variations in the voltage input to the IH power supply drive unit 80, the type of sheet S that is used, and variations in the environment where the printer is installed. For example, if the input voltage lowers, switching is controlled for a larger current to be supplied to the switching element 86 in order to maintain the power setting. This makes it easy for the temperature of the switching element 86 to rise.

If, for example, thicker than standard paper is used, the amount of heat consumed by the sheet S per unit time grows larger than usual. This makes it easier for the fixing roller temperature to fall during continuous printing. To prevent this, switching is controlled for a larger current to be supplied to the switching element 86 in order to increase the amount of heat of the fixing roller 101 generated per unit time as compared to when normal paper is used, which easily leads to an increase in temperature of the switching element 86.

Furthermore, if the printer is turned on when the surrounding environment is at a low temperature, the temperature of the fixing unit 2 of the printer can also be expected to be low, thus increasing the difference between the current temperature and the temperature range necessary for fixing. This may result in the power setting reaching a maximum value (for example, 1500 W), so that the switching is controlled to supply the maximum current to the switching element 86, which easily leads to an increase in temperature of the switching element 86.

In FIG. 4A, the future temperature of the switching element 86 is predicted at time point ta, the current time point (prediction point). The temperature of the switching element 86 at a future time point tb is predicted based on the change in temperature of the switching element 86 from a past time point tc until the current time point ta.

If the predicted temperature is at least Ts1 and is less than Ts2 (dashed line P), then first control is performed in parallel with image formation operations. The first control is performed if the predicted temperature is at least Ts1, even if the temperature of the switching element 86 at the current time point ta is less than Ts1. Switching control of the switching element 86 is restricted until the time point ta.

As a result, after the time point ta, the temperature of the switching element 86 begins to drop from the temperature at the time point ta (alternating long and short dashed line Q). When the first control is not performed, the probability that the temperature of the switching element 86 will continue to rise after the time point ta is high. Since the predicted temperature is at least Ts1, it is predicted that if the temperature continues to rise, the temperature at time point tb will in fact be at least Ts1. By performing the first control, the rise in temperature is prevented from continuing.

When the switching of the switching element 86 is restricted, the power supplied to the excitation coil 131 is reduced. Therefore, as shown by the alternating long and short dashed line E in FIG. 4B, the fixing roller temperature also starts to decrease from the temperature at time point ta.

Before reaching the time point tb, the restriction on the switching of the switching element 86 is lifted. As a result, the power supplied to the excitation coil 131 starts to increase. By lifting the restriction on switching, the rate of decrease in the temperature of the switching element 86 lowers, but the temperature does not suddenly rise. After the time point tb, if a large amount of power continues to be supplied to the excitation coil 131, the temperature gradually rises as before the time point ta.

Due to the increase in power supplied to the excitation coil 131, the fixing roller temperature transitions from a drop to a rise, as shown by the alternating long and short dashed line E in FIG. 4B. By the time point tb, the fixing roller temperature has exceeded the lower limit Tr1 and reached the temperature range necessary for fixing. Note that for a lower heat capacity of the fixing roller 101, the increase in temperature after the fixing roller temperature transitions from a drop to a rise is quicker, resulting in the fixing roller temperature more easily reaching the temperature range necessary for fixing.

By contrast, when the first control is not performed (as in a conventional structure), restriction of the switching of the switching element 86 begins after the time point ta, when the temperature of the switching element 86 actually exceeds Ts1. Therefore, as shown by the dotted line F in FIG. 4B, the time at which the fixing roller temperature begins to drop is later than when the first control is performed.

By restricting switching of the switching element 86, the temperature of the switching element 86 decreases, and upon falling below the predetermined temperature Ts1, the power supplied to the excitation coil 131 is increased, and the fixing roller temperature rises. The start of this rise in fixing roller temperature is delayed, however, by the same delay in the start of restriction of switching. As a result, at the time point tb, the fixing roller temperature has not reached the lower limit Tr1.

The time point tb is the predicted time of arrival of the tip of the sheet S at the fixing nip N. Therefore, if the fixing roller temperature has not yet reached the lower limit Tr1 by the time point tb, the sheet S that passes through the fixing nip N cannot be provided with sufficient heat for fixing, leading to a reduction in fixity.

By performing the first control, the rise in temperature of the switching element 86 is prevented, while also suppressing a reduction in fixity by causing the fixing roller temperature to rise to the temperature range necessary for fixing by the time point tb. The first control thus allows for excellent fixing.

Figure 5:
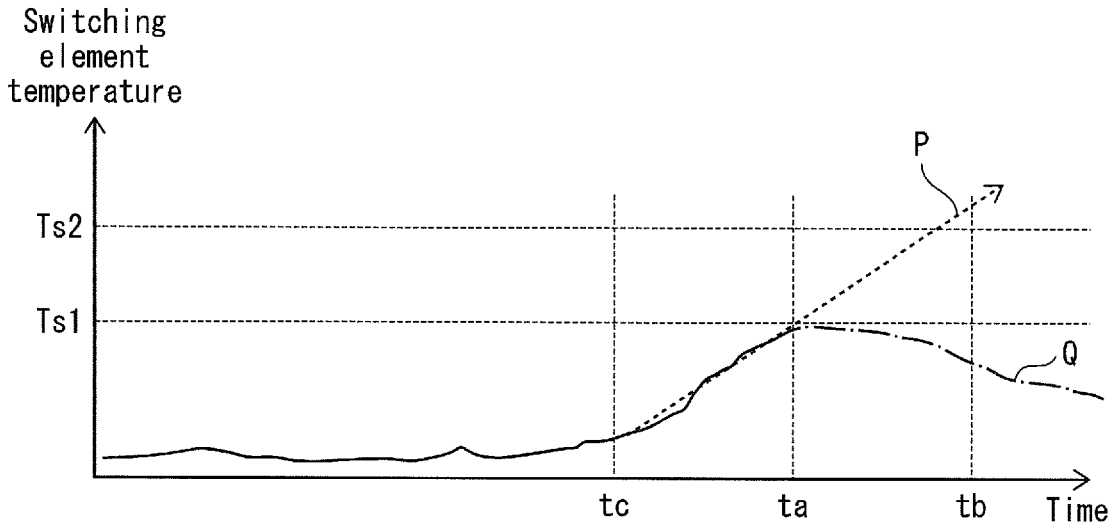
FIG. 5 shows an example of temperature changes in the switching element during second control.

FIG. 5 shows an example of temperature changes in the switching element 86 during second control, showing the case when the predicted temperature of the switching element 86 is equal to or greater than Ts2, as indicated by the dashed line P. In this case, the image formation operations are temporarily suspended, and by restricting switching of the switching element 86 similar to the first control, the temperature of the switching element 86 lowers, as shown by the alternating long and short dashed line Q.

FIGS. 6A through 6C are conceptual diagrams illustrating the switching between regular control and control to prevent an excess rise in switching element temperature in terms of the time relationship between the first time point and the second time point.

FIG. 6A shows the case when the predicted temperature Tsp of the switching element 86 is less than 80° C. (Ts1). In this case, regular control is performed between the first time point and the second time point.

FIG. 6B shows the case when the predicted temperature Tsp is at least 80° C. and less than 100° C. (Ts2). In this case, instead of the regular control, control to prevent an excess rise in switching element temperature (first control) is performed between the first time point and the second time point.

FIG. 6C shows the case when the predicted temperature Tsp is at least 100° C. In this case, the image formation operations are temporarily suspended starting at the first time point, and control to prevent an excess rise in switching element temperature (second control) is performed. At the second time point, the temperature of the switching element 86 at a third time point is predicted. If the predicted temperature Tsp is less than Ts2, the image formation operations recommence, and the first control is performed. Note that if the predicted temperature Tsp at the second time point is at least 100° C., a determination to prohibit the job is made, as shown by the dotted line.

During control to prevent an excess rise in switching element temperature, as during the regular control, the fixing temperature control unit 57 specifies a power setting for the magnitude of the power supplied to the coil to the IH power supply drive unit 80. The specified power setting is equal to the power setting during regular control multiplied by a predetermined coefficient (greater than zero, and less than or equal to one). Note that the specification of the power setting is provided at the same predetermined interval as the regular control. Hereinafter, during the regular control and the control to prevent an excess rise in switching element temperature, the power setting specified to the IH power supply drive unit 80 is referred to as the "specified power".

Returning to FIG. 3, the first timer 58 is used to time the predetermined intervals at which the power setting is specified, and the second timer 59 is used to time the first time point, the second time point, and the like during control to prevent an excess rise in switching element temperature.

The CPU 52 reads necessary programs from the ROM 53 and comprehensively controls the print unit 1, the fixing unit 2, and the like for smooth image formation operations. In addition to receiving information input via the operation panel 4 by user operation, the CPU 52 causes messages for the user to be displayed on the liquid crystal display of the operation panel 4. The RAM 54 is a work area for the CPU 52.

(4) Circuit Configuration of IH Power Supply Drive Unit 80

Figure 7:
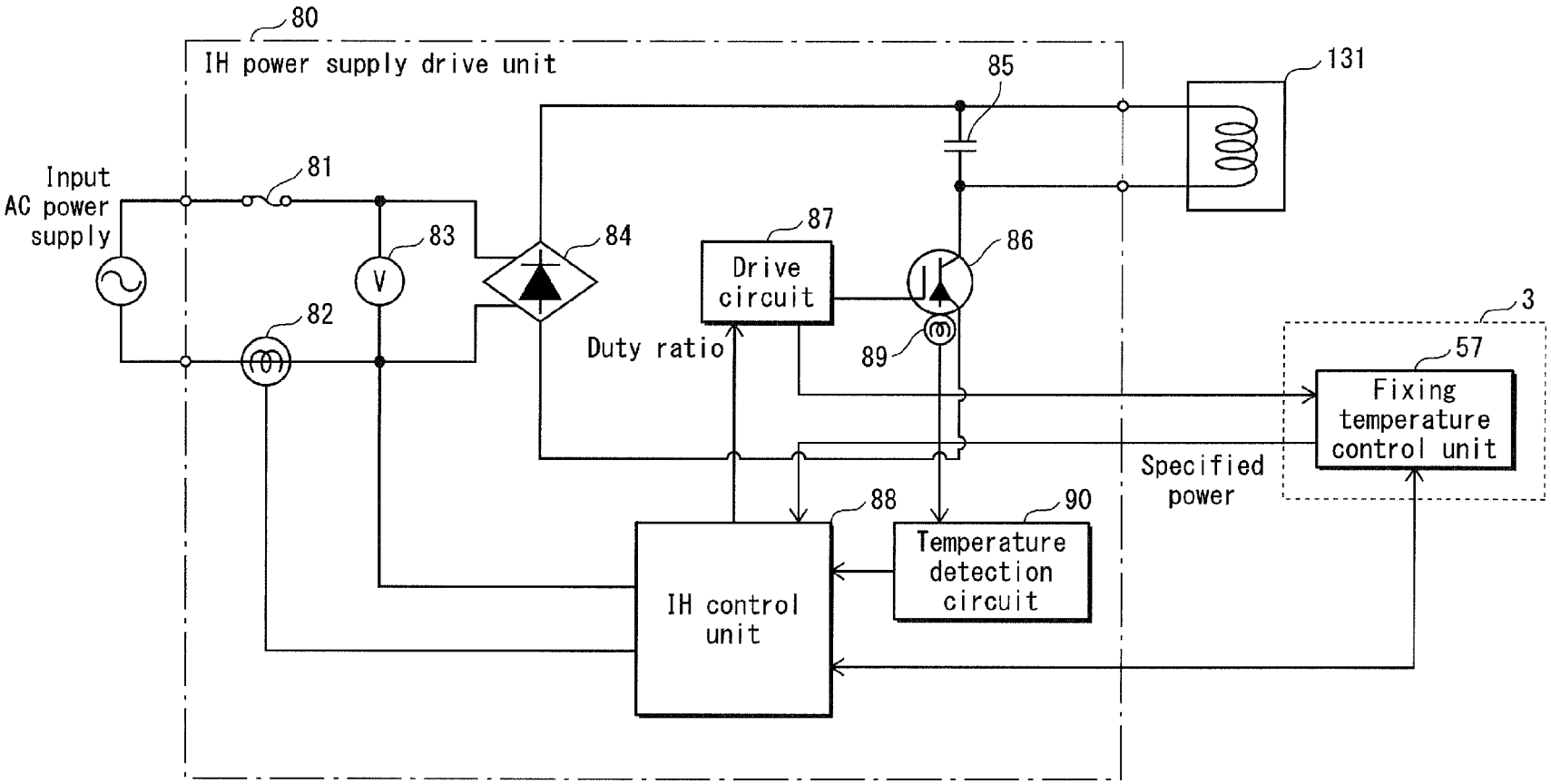
FIG. 7 shows an outline of the circuit configuration of an IH power supply drive unit.

FIG. 7 shows an outline of the circuit configuration of the IH power supply drive unit 80.

The IH power supply drive unit 80 is a circuit for variable control of the power supplied to the excitation coil 131, so that a power of the same magnitude as the specified power, specified by the fixing temperature control unit 57 of the control unit 3, is provided to the excitation coil 131. As shown in FIG. 7, the IH power supply drive unit 80 is provided with a fuse 81, an ammeter 82, a voltmeter 83, a rectifier circuit 84, a resonance capacitor 85, the switching element 86, a drive circuit 87, an IH control unit 88, a switching element temperature sensor 89, and a temperature detection circuit 90.

The fuse 81 protects the circuitry by preventing a large current from flowing into the circuitry from a power source of commercial alternating current. The ammeter 82 detects the current value of the alternating current, and the voltmeter 83 detects the voltage of the alternating current.

The rectifier circuit 84 converts alternating current into direct current. Together, the resonance capacitor 85 and the excitation coil 131 form an LC resonance circuit. In this embodiment, an Insulated Gate Bipolar Transistor (IGBT) is used as the switching element 86, which switches the current flowing to the excitation coil 131 on and off. Via this switching, current flows to the LC resonance circuit formed by the excitation coil 131 and the resonance capacitor 85, and magnetic flux for heating the electromagnetic induction heating layer 121 of the fixing roller 101 is produced by the excitation coil 131. Note that the switching element is not limited to an IGBT. A different device may be used.

The drive circuit 87 is a circuit that outputs driving voltage in a pulse waveform to the gate of the IGBT, which serves as the switching element 86. The switching element temperature sensor 89 outputs a signal indicating the temperature of the switching element 86. The temperature detection circuit 90 converts the detection signal from the switching element temperature sensor 89 to a temperature value of the switching element 86 and transmits the result to the IH control unit 88.

At each predetermined interval, the IH control unit 88 receives the specified power from the fixing temperature control unit 57. Based on results of detection by the ammeter 82 and voltmeter 83 at each interval, the IH control unit 88 specifies a duty ratio to the drive circuit 87 for the driving voltage to be output to the IGBT 86 so that the power supplied to the excitation coil 131 will have the same magnitude as the specified power. This duty ratio indicates the ratio of the on time to the off time during on/off switching by the switching element 86. For a larger duty ratio, more power is supplied to the switching element 86, and therefore more power is supplied to the excitation coil 131.

In this embodiment, considering how the value of the input power from the commercial AC power source varies, information that associates input power values, specified powers, and duty ratios for the drive signal in advance is stored in a memory (not shown in the figures) provided in the IH control unit 88. This information indicates how to adjust the duty ratio of the drive signal so that, even when the value of the input power changes, power of the same magnitude as the specified power can be supplied to the excitation coil 131.

The IH control unit 88 refers to this information to calculate the duty ratio of the drive signal corresponding to the specified power and to the current input power value from the commercial AC power supply. The IH control unit 88 transmits the information on the duty ratio for the calculated drive signal to the drive circuit 87.

The drive circuit 87 applies driving voltage to the gate of the switching element 86 so that the switching element 86 performs switching at the duty ratio specified by the IH control unit 88. As a result, the switching element 86 performs switching so that power of the same magnitude as the specified power specified by the control unit 3 is provided to the excitation coil 131.

(5) Structure of Fixing Temperature Control Unit 57

Figure 8:
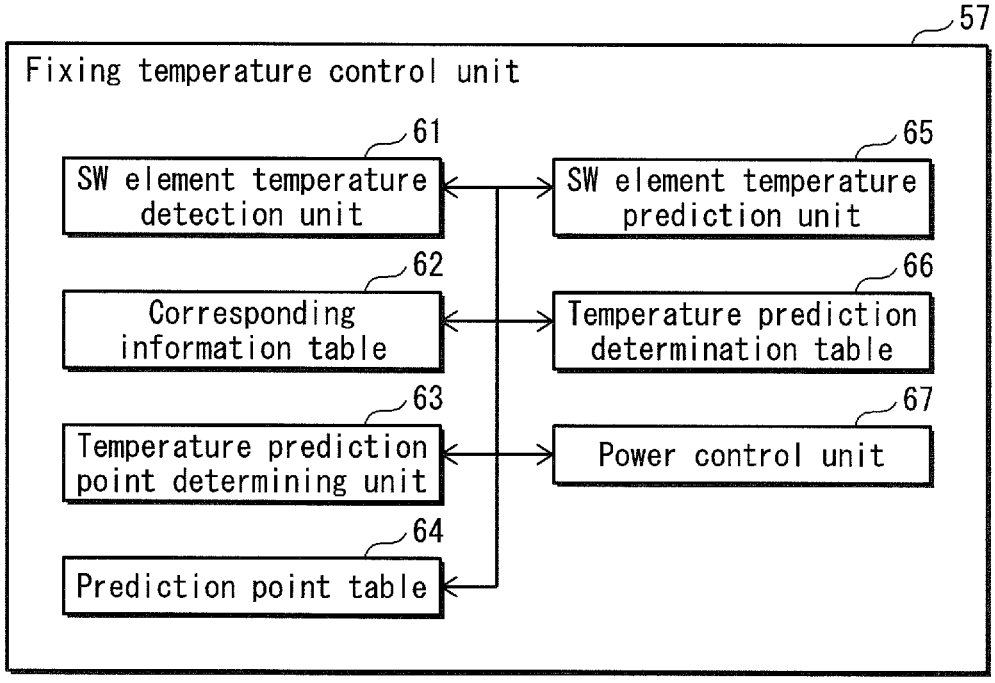
FIG. 8 is a block diagram showing the structure of a fixing temperature control unit.

FIG. 8 is a block diagram showing the structure of the fixing temperature control unit 57.

As shown in FIG. 8, the fixing temperature control unit 57 is provided with an SW element temperature detection unit 61, a corresponding information table 62, a temperature prediction point determining unit 63, a prediction point table 64, an SW element temperature prediction unit 65, a temperature prediction determination table 66, and a power control unit 67.

The SW element temperature detection unit 61 performs switching element temperature detection processing (described below).

As shown in FIG. 9, the corresponding information table 62 stores a history of corresponding information associating time, the temperature of the switching element 86, and the specified power. This corresponding information is written during the switching element temperature detection processing.

Returning to FIG. 8, the temperature prediction point determining unit 63 performs prediction point determination processing (described below) to determine a time point (prediction point: first time point) at which to predict the future temperature of the switching element 86.

The prediction point table 64 is a table referred to when determining the prediction point. As shown in FIG. 10, the table includes information associating modes with respective prediction points.

Specifically, the color mode is associated with a prediction point immediately before the start of scanning for the color Y. The monochrome mode is associated with a prediction point immediately before the start of transportation for registration of the sheet S. The reason for these associations is described below.

Returning to FIG. 8, when the determined prediction point is reached, the SW element temperature prediction unit 65 performs switching element temperature prediction processing (described below) to predict the temperature of the switching element 86 at the estimated time of arrival of the tip of the sheet S at the fixing nip N (sheet arrival point: second time point).

The temperature prediction determination table 66 is referred to when the temperature of the switching element 86 is predicted. The content of the temperature prediction determination table 66 is described below.

The power control unit 67 outputs a specified power to the IH control unit 88 of the IH power supply drive unit 80 to specify the power to be supplied to the excitation coil 131. Based on the predicted temperature of the switching element 86, the power control unit 67 also switches between the regular control and control to prevent an excess rise in switching element temperature. Furthermore, the power control unit 67 exchanges signals and data with the IH power supply drive unit 80, acquires information from the drive circuit 87 indicating the status of switching of the switching element 86, and monitors whether switching is being performed adequately.

(6) Content of Switching Element Temperature Detection Processing

Figure 11:
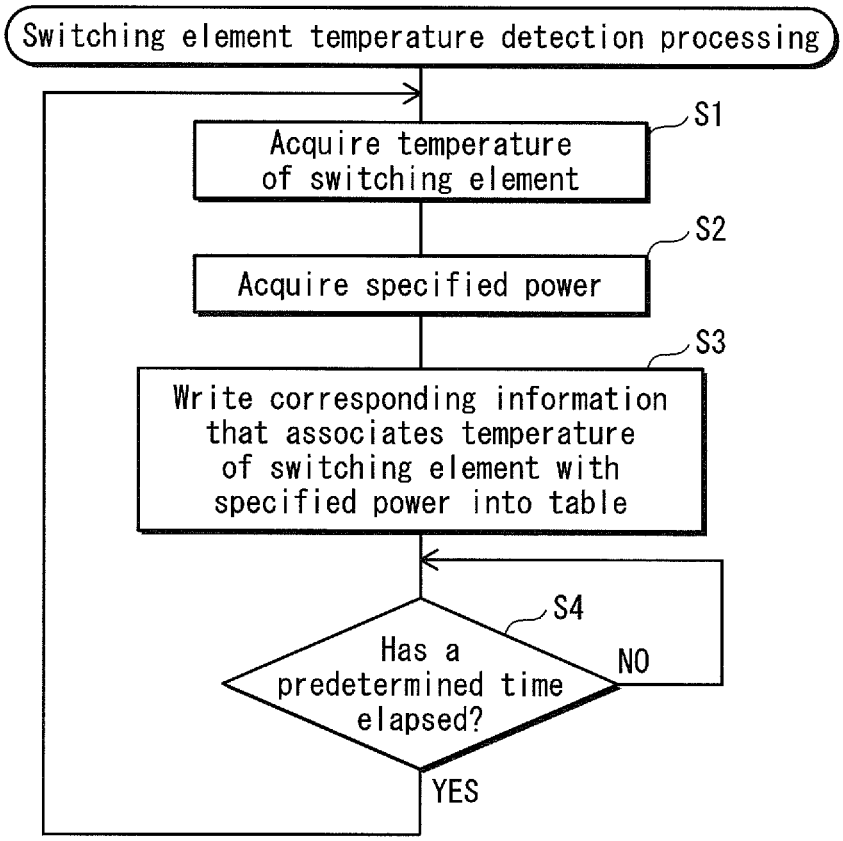
FIG. 11 is a flowchart showing the content of switching element temperature detection processing.

FIG. 11 is a flowchart showing the content of the switching element temperature detection processing.

While the power to the printer is turned on, the SW element temperature detection unit 61 repeatedly performs this processing over a predetermined cycle, for example every several milliseconds. The first timer 58 times this predetermined cycle.

As shown in FIG. 11, the current temperature (measured value) of the switching element 86 is acquired (step S1). The current temperature is acquired by receiving, from the IH control unit 88, information indicating the temperature of the switching element 86 detected by the IH power supply drive unit 80.

Next, the specified power currently being output to the IH control unit 88 is acquired from the power control unit 67 (step S2). The acquired specified power is information indicating the amount of power currently being supplied to the excitation coil 131.

The acquired temperature of the switching element 86 and the specified power are associated with the current time and written in the corresponding information table 62 (step S3). After a predetermined time elapses (step S4: YES), processing returns to step S1, and the processing from steps S1 to S4 is repeated.

By repeating this processing over predetermined intervals, corresponding information that associates each time with the temperature of the switching element 86 and the specified power is written in the corresponding information table 62 and accumulated as history. The times t1, t2, tn in FIG. 9 are shown in chronological order of the predetermined intervals. The difference in time between time t(n−1) and tn corresponds to one predetermined interval and is a sampling interval for the corresponding information.

(7) Content of Fixing Temperature Control

Figure 12:
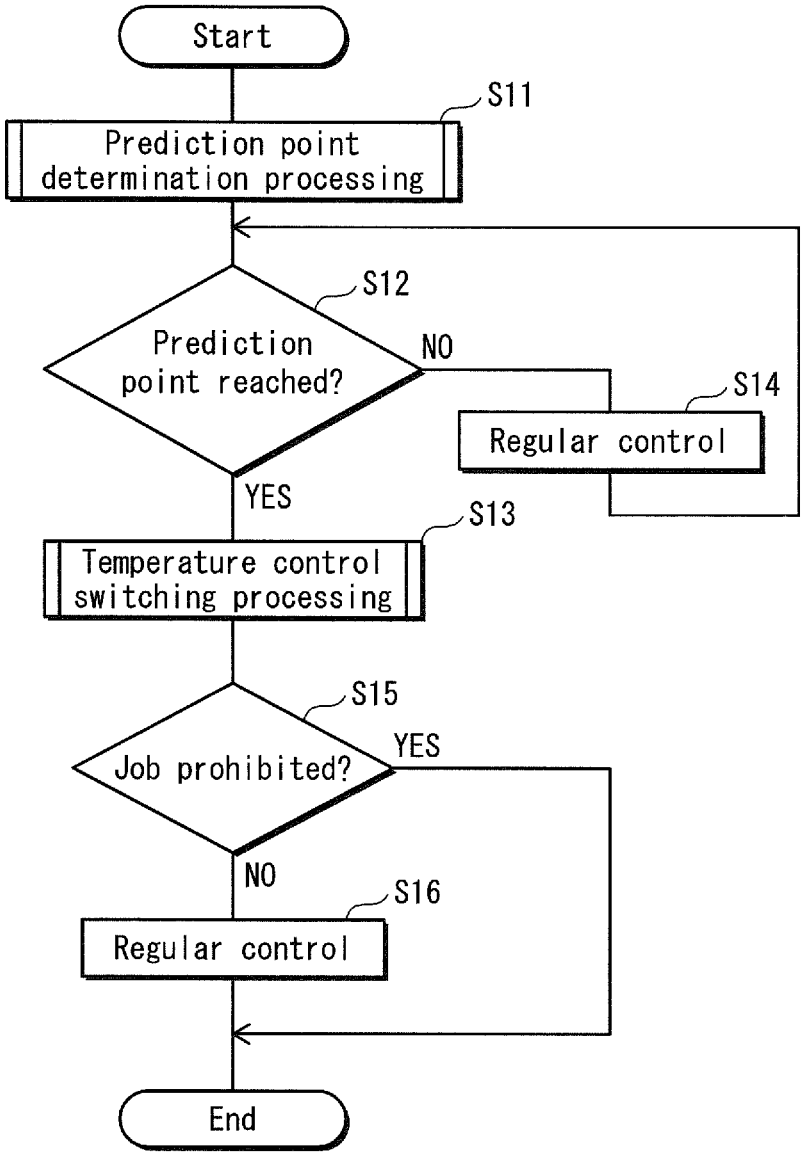
FIG. 12 is a flowchart showing the content of fixing temperature control.

FIG. 12 is a flowchart showing the content of fixing temperature control.

This control starts simultaneously with the start of the print job corresponding to one sheet S (hereinafter referred to as a "job X"). The print control unit 56 transmits information indicating the start of a job X to the fixing temperature control unit 57 at the start of the job X. The fixing temperature control unit 57 can determine that the job X has started by receiving this information. First, fixing temperature control is outlined in general. Details are provided below.

<General Outline>

First, prediction point determination processing is performed to determine the prediction point (step S11).

Once the prediction point has been determined, it is determined whether the prediction point has been reached during performance of the job X (step S12).

If it is determined that the prediction point has not been reached (step S12: NO), then regular control is performed (step S14), and processing returns to step S12. Regular control is performed until the prediction point is reached. This corresponds to performance of the regular control until the first time point as shown in FIGS. 6A through 6C.

When it is determined that the prediction point has been reached (step S12: YES), temperature control switching processing is performed (step S13). As a result of temperature control switching processing, either regular control or control to prevent an excess rise in switching element temperature is selected. This corresponds to switching, between the first time point and the second time point, between the regular control shown in FIG. 6A and the control to prevent an excess rise in switching element temperature shown in FIGS. 6B and 6C.

Once the temperature control switching processing is complete, as long as it is not determined to prohibit the job during the temperature control switching processing (step S15: NO), regular control is performed (step S16), and the fixing temperature control terminates. This corresponds to performance of the regular control starting at the second time point shown in FIG. 6B. Note that in parallel with performance of the print job, switching element temperature detection processing by the SW element temperature detection unit 61 is performed. Therefore, the corresponding information is written into the corresponding information table 62 at predetermined intervals.

If it is determined to prohibit the job (step S15: YES), the fixing temperature control terminates. In this case, since the print job is prohibited, power supply to the excitation coil 131 is suspended, as described below.

Note that if a print job involving multiple sheets S is being performed, then the fixing temperature control is performed for each sheet.

<Detailed Description>

(7-1) Content of Prediction Point Determination Processing

Figure 13:
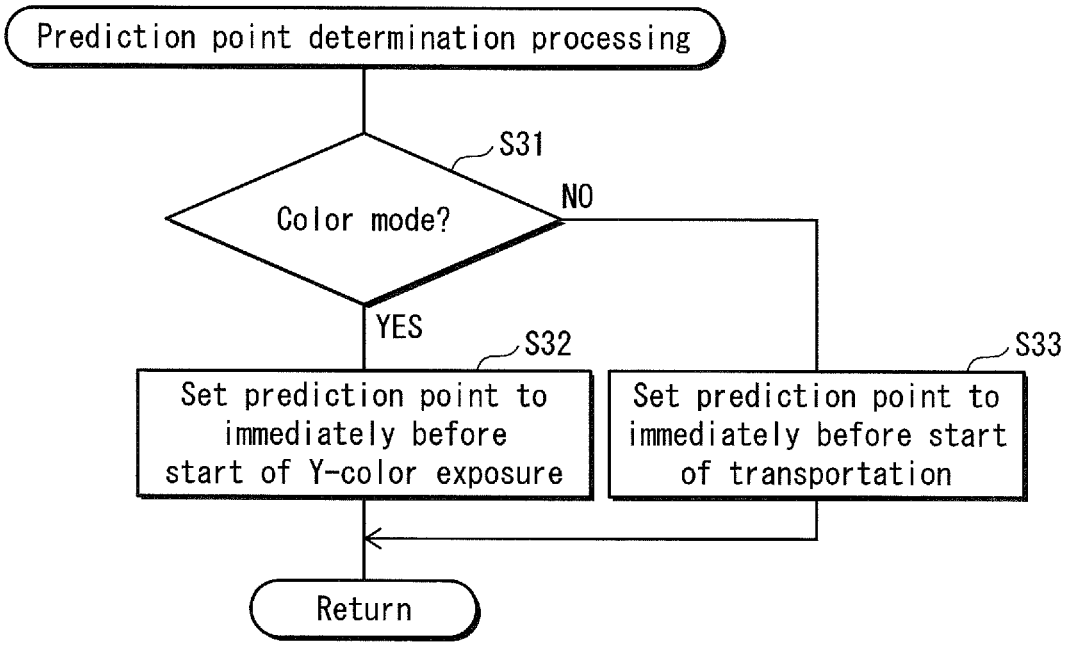
FIG. 13 is a flowchart showing the content of prediction point determination processing.

FIG. 13 is a flowchart showing the content of a subroutine for prediction point determination processing. The temperature prediction point determining unit 63 performs this processing.

As shown in FIG. 13, it is determined whether the job X is being performed in color mode or in monochrome mode (step S31). This determination is made by receiving information indicating the mode of the job X from the print control unit 56.

If it is determined that the mode is color (step S31: YES), then the prediction point is set to immediately before the start of Y-color exposure by referring to the prediction point table 64 (step S32), and processing returns. Conversely, if the mode is determined not to be color, i.e. if the mode is monochrome (step S31: NO), then the prediction point is set to immediately before the start of transportation for registration by referring to the prediction point table 64 (step S33), and processing returns.

In this context, the "start of Y-color exposure" refers to the time point at which scanning of Y-color image data begins for image formation on one sheet S. "Immediately before the start of Y-color exposure" refers to a time point that is a time tz (several milliseconds) before the start of Y-color exposure.

The "start of transportation for registration" refers to the timing at which a sheet S begins to be transported by the pair of resist rollers 33 to the second transfer position 25. "Immediately before the start of transportation for registration" refers to a time tz before the start of transportation for registration. The determined prediction point, i.e. either immediately before the start of exposure or immediately before the start of transportation for registration, is treated as the first time point indicating the time immediately before the start of image formation operations for the sheet S. At this first time point, temperature control switching processing (step S13) is performed. Information on the start of exposure and the start of transportation for registration is acquired from the print control unit 56.

The print control unit 56 manages a job start time for each job and, using the time as a base point, controls the timing of processes such as charging, exposure, development, transfer, the start of transportation for registration, and the like in order to perform image formation operations. Therefore, predicted times for the start of exposure and the start of transportation for a job X can be identified. By acquiring this time information from the print control unit 56, the fixing temperature control unit 57 identifies the times immediately before the start of exposure and the start of transportation for registration.

The reason for changing the prediction point (first time point) in accordance with the mode (color or monochrome) is as follows. In the printer of the present embodiment, the order of the start of Y-color exposure and the start of transportation for registration differs between color mode and monochrome mode. The prediction point is changed so that in either mode, the prediction point is immediately before the earlier of the two. This issue is described in detail with reference to FIG. 14.

Figure 14:
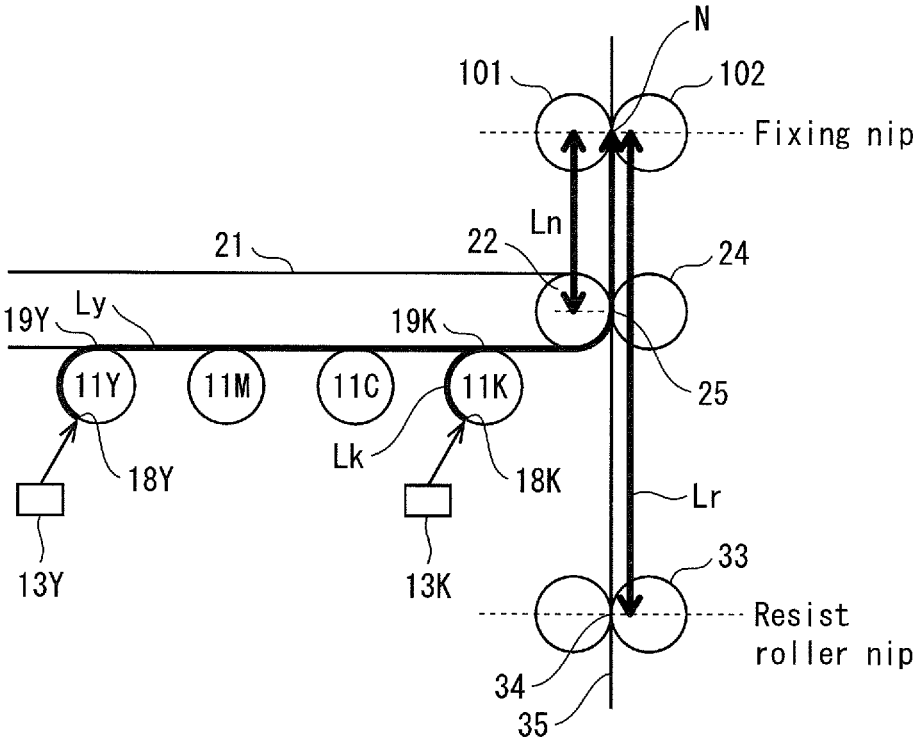
FIG. 14 schematically shows the positional relationships between photoconductive drums, an intermediate transfer belt, a secondary transfer roller, a pair of resist rollers, and a fixing nip.

FIG. 14 schematically shows the positional relationships between the photoconductor drums 11Y through 11K, the intermediate transfer belt 21, the secondary transfer roller 24, the pair of resist rollers 33, and the fixing nip N.

As shown in FIG. 14, the exposure position of the exposure unit 13Y on the photoconductor drum 11Y is indicated by 18Y, the primary transfer position on the photoconductor drum 11Y is indicated by 19Y, the exposure position of the exposure unit 13K on the photoconductor drum 11K is indicated by 18K, the primary transfer position on the photoconductor drum 11K is indicated by 19K, the secondary transfer position is indicated by 25, and a resist roller nip formed by the pair of resist rollers 33 is indicated by 34.

The distance Ly indicates the sum of the following distances: the distance from the exposure position 18Y on the circumferential surface of the photoconductor drum 11Y to the primary transfer position 19Y in the direction of drum rotation, the distance from the primary transfer position 19Y to the secondary transfer position 25 along the surface of the intermediate transfer belt 21 in the direction of rotation thereof, and a distance Ln from the secondary transfer position 25 to the transfer nip N along the conveyance path 35.

A distance Lk indicates the sum of the following distances: the distance from the exposure position 18K on the circumferential surface of the photoconductor drum 11K to the primary transfer position 19K in the direction of drum rotation, the distance from the primary transfer position 19K to the secondary transfer position 25 along the surface of the intermediate transfer belt 21 in the direction of rotation thereof, and the distance Ln. A distance Lr indicates the distance along the conveyance path 35 from the resist roller nip 34 through the secondary transfer position 25 to the transfer nip N. The relationship between the magnitudes of the distances Ly, Lk, and Lr is expressed as $Lk<Lr<Ly$.

The circumferential speed of the photoconductor drums 11Y through 11K, the rotational speed of the intermediate transfer belt 21, and the transport speed of the sheet S are set to the same speed V, which is the system speed. Furthermore, the distance Ln included in the distances Ly, Lk, and Lr is the same length in each case.

When operating in color mode (colors Y through K), the page tip of the Y through K-color toner image formed on the intermediate transfer belt 21 for one page and the tip of a sheet S reach the secondary transfer position 25 simultaneously by having the pair of resist rollers 33 start transporting the sheet S (start of transportation for registration) after a predetermined time elapses from the start of exposure for the color Y. Since the distance Lr is less than the distance Ly, the predetermined time is yielded by dividing the difference between the distances Lr and Ly by the speed V. In this way, secondary transfer can be performed without misalignment in the transport direction between the toner image and the sheet S.

On the other hand, when operating in monochrome mode (K color), the page tip of the K-color toner image formed on the intermediate transfer belt 21 for one page and the tip of a sheet S reach the secondary transfer position 25 simultaneously by starting exposure for the color K after a predetermined time elapses from the start of transportation for registration of the sheet S by the pair of resist rollers 33. Since the distance Lk is less than the distance Lr, the predetermined time is yielded by dividing the difference between the distances Lk and Lr by the speed V. In this way, secondary transfer can be performed without misalignment in the transport direction.

During color mode, the start of Y-color exposure thus begins earlier than the start of transportation for registration of the sheet S. Accordingly, treating the start of Y-color exposure as the start of image formation operations and setting the prediction point to be immediately before this time allows for the start of image formation operations to be temporarily suspended if the future temperature of the switching element 86 predicted at the prediction point is higher than a predetermined value. Once the temperature of the switching element 86 lowers, the image formation operations can then be resumed. This prevents the switching element 86 from reaching a high temperature.

On the other hand, during monochrome mode, the start of transportation for registration of the sheet S begins earlier than the start of K-color exposure. Accordingly, as during color mode, treating the start of transportation for registration of the sheet S as the start of image formation operations and setting the prediction point to be immediately before this time allows for the start of image formation operations to be temporarily suspended at the prediction point and resumed after the temperature of the switching element 86 lowers.

If the job X is in color mode, it is determined in step S12 of FIG. 12 that the prediction point has been arrived at upon the start of Y-color exposure. If the job X is in monochrome mode, it is determined that the prediction point has been arrived at upon the start of transportation for registration.

(7-2) Content of Temperature Control Switching Processing

Figure 15:
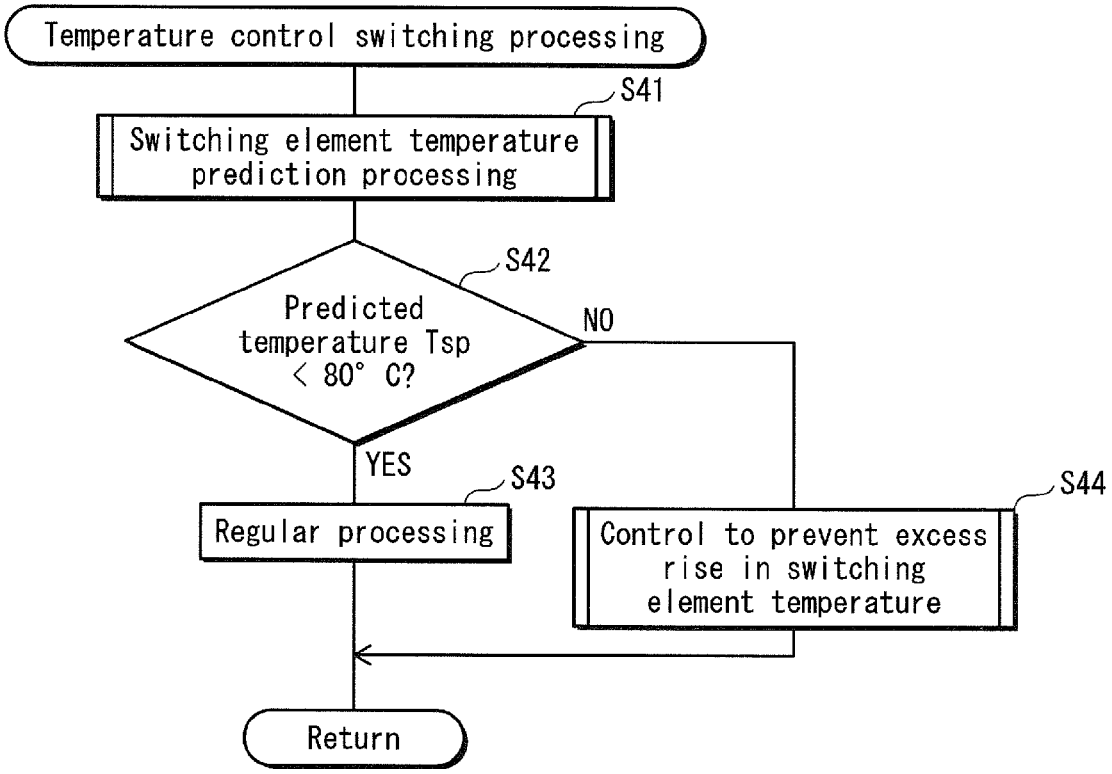
FIG. 15 is a flowchart showing the content of temperature control switching processing.

FIG. 15 is a flowchart showing the content of a subroutine for temperature control switching processing.

As shown in FIG. 15, switching element temperature prediction processing (step S41) is performed.

(7-2-1) Content of Switching Element Temperature Prediction Processing

Figure 16:
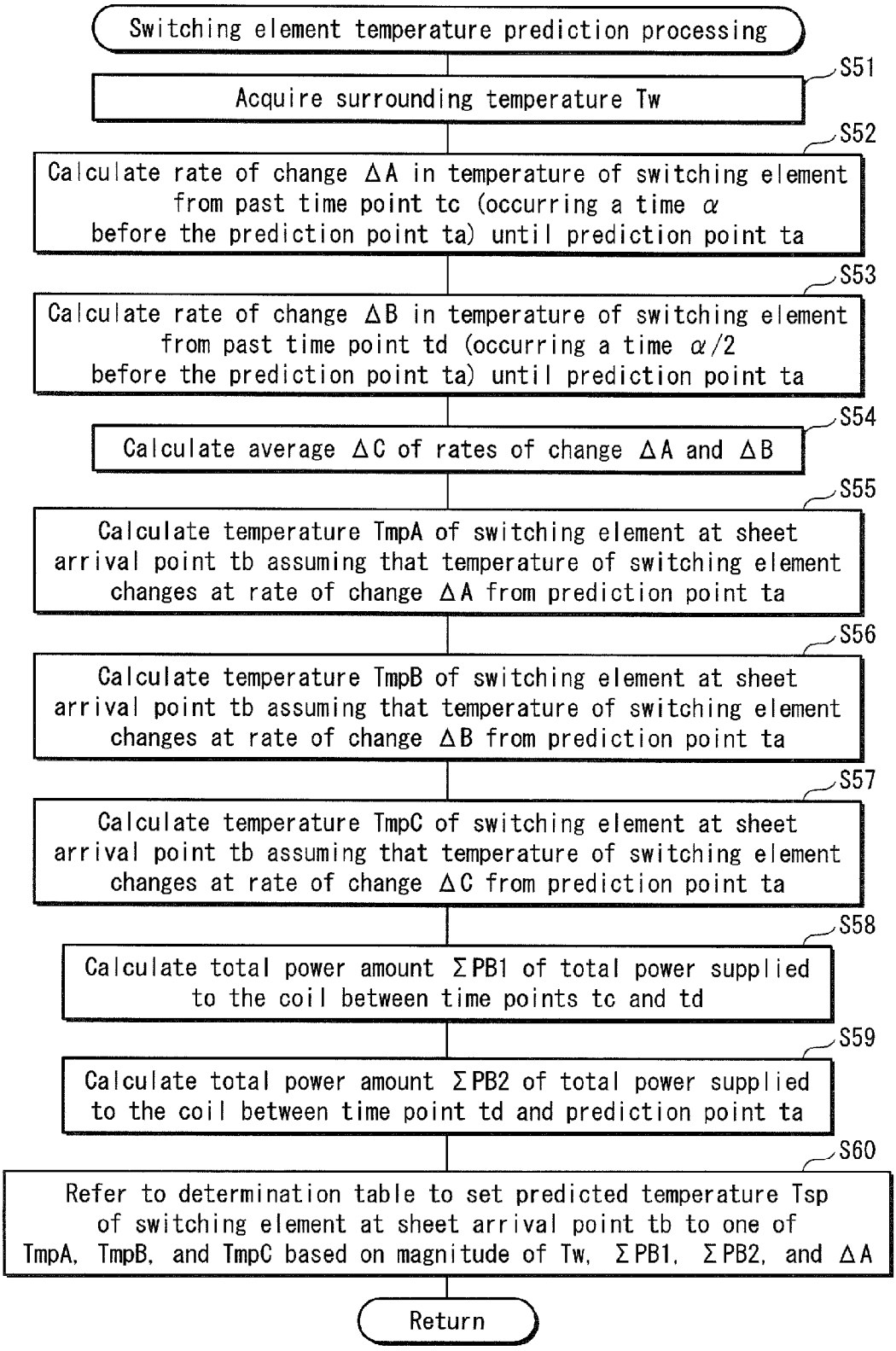
FIG. 16 is a flowchart showing the content of switching element temperature prediction processing.
Figure 17:
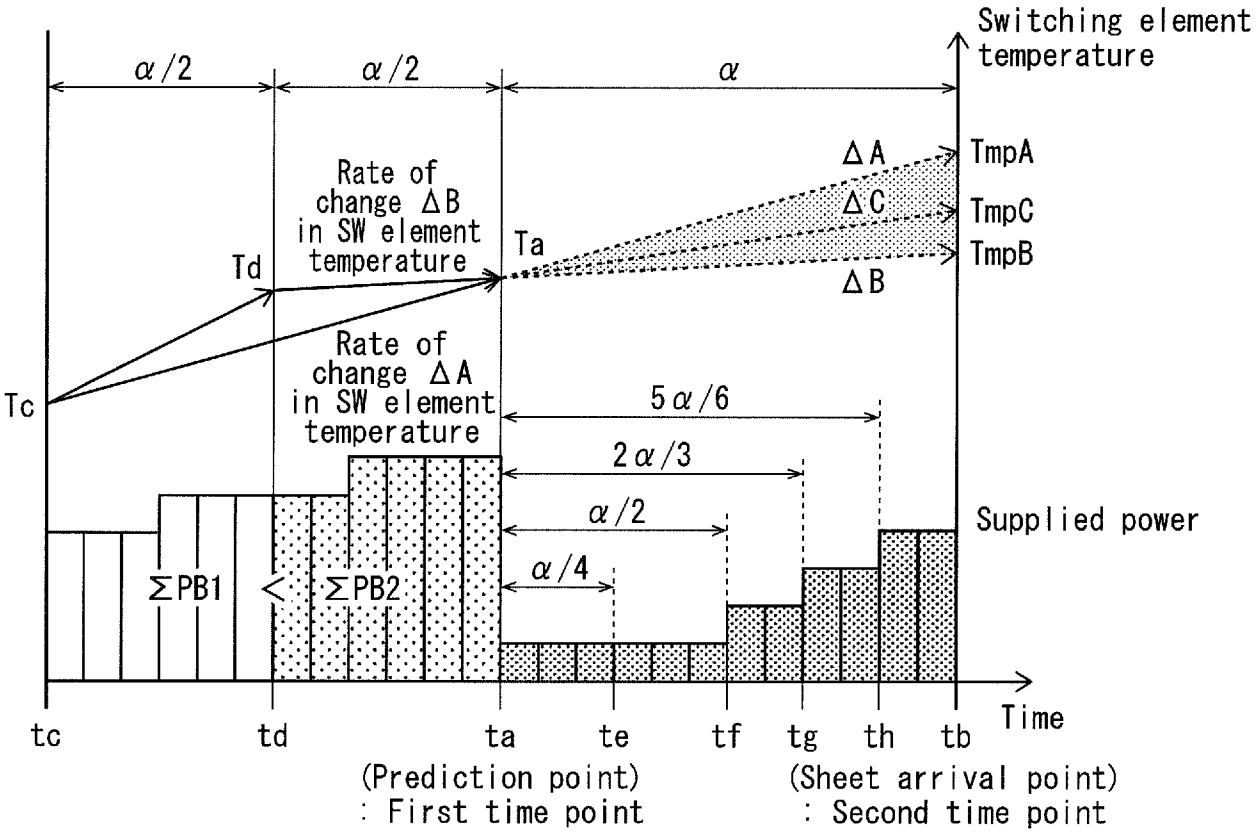
FIG. 17 outlines the method for switching element temperature prediction processing.

FIG. 16 is a flowchart showing the content of the subroutine for switching element temperature prediction processing, and FIG. 17 outlines the method for switching element temperature prediction processing. The SW element temperature prediction unit 65 performs the switching element temperature prediction processing.

In FIG. 17, time is shown on the horizontal axis, and the temperature of the switching element 86 as well as the power supplied to the excitation coil 131 are shown in the vertical axis. The lines indicate the temperature of the switching element 86, whereas the rectangles in the graph indicate the power supplied to the coil. Along the time axis, the time point to is the prediction point (first time point). The time point tb is the sheet arrival point (second time point). The time point tc is a time $\alpha$ before the time point ta, and the time point td is a time ($\alpha/2$) before the time point ta. The time points te, tf, tg, and th between the time points ta and tb are described below.

Assuming that the prediction point ta (time point at which the future temperature of the switching element 86 is predicted) is the current time, the prediction point ta acts as a boundary, with the time points tc and td in the past, and the sheet arrival point tb in the future.

As shown in FIG. 16, the surrounding temperature Tw is acquired (step S51). The surrounding temperature Tw is acquired by receiving a detection signal from the surrounding temperature sensor 29.

Letting the rate of change in temperature of the switching element 86 from the past time point tc until the prediction point ta, i.e. the current time, be $\Delta A$, the change in temperature of the switching element 86 over time is calculated (step S52). This calculation is performed as follows.

Referring to the corresponding information table 62 (FIG. 9), the temperature Tc of the switching element 86 at the past time point tc, which is the time $\alpha$ before the current time, is acquired. Information indicating the temperature Ta of the switching element 86 at the present prediction point ta is also acquired from the temperature detection circuit 90. The temperature Tc is subtracted from the temperature Ta and the result is divided by the time $\alpha$ to yield the rate of change $\Delta A$.

If the temperature Tc is less than the temperature Ta, the rate of change $\Delta A$ is positive. Conversely, if Tc>Ta, the rate of change $\Delta A$ is negative. FIG. 17 shows an example of a positive rate of change $\Delta A$. The relationship between the magnitude of the temperatures and the sign of the rate of change is the same for the rates of change $\Delta B$ and $\Delta C$ described below.

Next, the rate of change $\Delta B$ of the temperature of the switching element 86 from the past time point td until the prediction point ta is calculated (step S53). This calculation is similar to the rate of change $\Delta A$: the temperature Td at the past time point td is subtracted from the temperature Ta, and the result is divided by a time ($\alpha/2$). This rate of change $\Delta B$ similarly expresses the change in temperature of the switching element 86 over time between the time points td and ta.

An average $\Delta C$ of the rate of change $\Delta A$ and the rate of change $\Delta B$ is calculated (step S54).

A temperature TmpA of the switching element 86 at the sheet arrival point tb is then calculated assuming that the temperature of the switching element 86 changes at the rate of change $\Delta A$ from the current prediction point ta until the sheet arrival point tb (step S55). This calculation is made by adding the temperature Ta to a value yielded by multiplying the rate of change $\Delta A$ by the time $\alpha$.

Next, a temperature TmpB of the switching element 86 at the sheet arrival point tb is calculated assuming that the temperature of the switching element 86 changes at the rate of change $\Delta B$ from the prediction point ta until the sheet arrival point tb (step S56). The method of calculating the temperature TmpB is similar to the method of calculating the temperature TmpA.

Furthermore, a temperature TmpC of the switching element 86 at the sheet arrival point tb is calculated assuming that the temperature of the switching element 86 changes at the rate of change $\Delta C$ from the prediction point ta until the sheet arrival point tb (step S57). The method of calculating the temperature TmpC is similar to the method of calculating the temperature TmpA.

Next, a total power amount $\Sigma$PB1 (see FIG. 17) is calculated to indicate the total power supplied to the coil during a first time slot between the past time points tc and td (step S58).

This calculation is made by referring to the corresponding information table 62 and summing each specified power between the past time points tc and td multiplied by the sampling interval.

Similarly, a total power amount $\Sigma$PB2 (see FIG. 17) is calculated to indicate the total power supplied to the coil during a second time slot between the past time point td and the prediction point to (step S59). This calculation is performed similarly to the calculation of the total power amount $\Sigma$PB1.

Referring to the temperature prediction determination table 66, the predicted temperature Tsp of the switching element 86 at the sheet arrival point tb is selected from among the temperatures TmpA, TmpB, and TmpC, based on the surrounding temperature Tw, the total power amounts $\Sigma$PB1 and $\Sigma$PB2, and the size of the rate of change $\Delta A$ (step S60). Processing then returns.

FIG. 18 shows the content of the temperature prediction determination table 66.

As shown in FIG. 18, the temperature prediction determination table 66 includes the following columns: surrounding temperature, total power amounts ($\Sigma$), rate of change ($\Delta A$), and predicted temperature (Tsp) of the SW element. These pieces of information are written in the table in association with each other.

For example, if the surrounding temperature Tw<20° C., the total power amounts are such that $\Sigma$PB1<$\Sigma$PB2, and the rate of change $\Delta A$ is positive, then the temperature TmpC is selected as the predicted temperature Tsp of the switching element 86. If the surrounding temperature Tw<20° C., the total power amounts are such that $\Sigma$PB1>$\Sigma$PB2, and the rate of change $\Delta A$ is negative or zero, then the smallest value among the temperatures TmpA through TmpC is selected as the predicted temperature Tsp. Furthermore, if 20° C.≤the surrounding temperature Tw<30° C., then regardless of the magnitudes of the total power amounts ($\Sigma$) and the rate of change ($\Delta A$), the temperature TmpC is selected.

If, for example, the surrounding temperature Tw≥30° C. and the rate of change $\Delta A$ is positive, then regardless of the relationship between the total power amounts ($\Sigma$), the largest value among the temperatures TmpA through TmpC is selected. The reason for the above selection method is as follows.

If the past rate of change ΔA is positive, the temperature of the switching element 86 is tending to rise. Therefore, it is predicted that the temperature will continue to rise after the prediction point ta.

The temperature may rise, however, in various ways. As shown in FIG. 17, the temperature may rise at a constant rate (rate of change ΔA) from the time point tc until the prediction point ta. On the other hand, the rate of increase may be high during the first time slot, between the time points tc and td, and then be lower than ΔA during a second time slot from the time point td until the prediction point ta (rate of change ΔB).

If the rate of increase changes in this way, it would be better to use only ΔB, i.e. the rate of change during the second time slot, which immediately precedes the prediction point ta. If the total power amount ΣPB2 for the second time slot is larger than the total power amount ΣPB1 for the immediately preceding first time slot, however, as in the example in FIG. 17, the power provided to the switching element 86 is continuing to increase. If the supplied power continues to increase after the prediction point ta, it can be assumed that the rate of increase in the temperature of the switching element 86 will be somewhat higher than the rate of change ΔB.

The amount by which the temperature increases is easily affected by the surrounding temperature. If the surrounding temperature, i.e. the temperature in the environment where the printer is installed, is low, for example less than 20° C., then the temperature inside of the printer is often low, in particular at the back of the apparatus where circuit substrates such as the IH power supply drive unit 80 are provided. In this case, the rise in temperature can easily be kept within a small range. However, when the surrounding temperature is, for example, 30° C. or higher, the amount of increase grows large.

As shown in the example in FIG. 17, when the rate of change ΔA>0, the rate of change ΔB<ΔA, and the total power amount ΣPB1<ΣPB2, the temperature TmpA calculated using the rate of change ΔA is the upper limit of the predicted values, the temperature TmpB calculated using the rate of change ΔB is the lower limit of the predicted values, and the average temperature TmpC falls between the temperatures TmpA and TmpB.

Based on the relationship between total power amounts, ΣPB1<ΣPB2, it can be assumed that the rate of change will rise above the lower limit ΔB, as described above. The accuracy of the predicted temperature can be increased, however, within the range of the upper and lower limits of the predicted temperatures as follows: if the surrounding temperature is low, then the temperature TmpC between the temperatures TmpA and TmpB is treated as the predicted temperature, whereas if the surrounding temperature is high, the temperature rises more easily, and therefore the temperature TmpA, which is the upper limit, is treated as the predicted temperature.

Even if the relationship between the surrounding temperature, the rate of change, and the relative size of the total power amounts differs from the relationship shown in FIG. 17, for example if ΣPB1=ΣPB2, ΣPB1>ΣPB2, ΔA=0, ΔA<0, and so forth, the same method as above can be used for each relationship in order to determine whether to select the upper limit, the lower limit, or the average of the predicted temperatures as the predicted temperature Tsp so as to improve the accuracy of the predicted temperature. FIG. 18 shows an example of different relationships. Using such a method to predict the temperature from a combination of the surrounding temperature, the rate of change, and the total power amounts allows for improved accuracy of prediction as, for example, compared to when the temperature is predicted only using the rate of change ΔA.

Note that at the prediction point ta, it suffices to calculate the predicted temperature Tsp of the switching element 86 at the sheet arrival point tb. Information associating the surrounding temperature, rate of change, total power amounts, and predicted temperature may be sought by experiment or the like and stored in advance in table format. Alternatively, a calculation formula may be established in advance, and the predicted temperature Tsp may be calculated using the formula. Furthermore, depending on the structure of the apparatus, either or both of the surrounding temperature and the total power amounts may be omitted from consideration if they have nearly no effect on temperature prediction. Furthermore, other configurations are possible, such as using only one of the rates of change ΔA through ΔC, or using a value between temperatures TmpA and TmpB as the predicted temperature.

Additionally, at prediction point ta, the past time points used for calculating change in temperature were described as being time points tc and td, respectively a time α and a time (α/2) before the prediction point ta. The amount by which these time points are earlier, however, is not limited to α and (α/2). As long as the change in temperature over time can be acquired, 2*a* or 3*a* may, for example, be used in lieu of the time α.

Returning to FIG. 15, in step S42, it is determined whether the predicted temperature Tsp of the switching element 86 is less than 80° C. If it is determined that the predicted temperature Tsp<80° C. (step S42: YES), then regular control is performed after the prediction point ta (step S43), and processing returns. The power control unit 67 performs the regular control. When the regular control is performed, the image formation operations begin on schedule.

Conversely, if the predicted temperature Tsp of the switching element 86 is determined to be at least 80° C. (step S42: NO), then control to prevent an excess rise in switching element temperature is performed (step S44), and processing returns.

Figure 19:
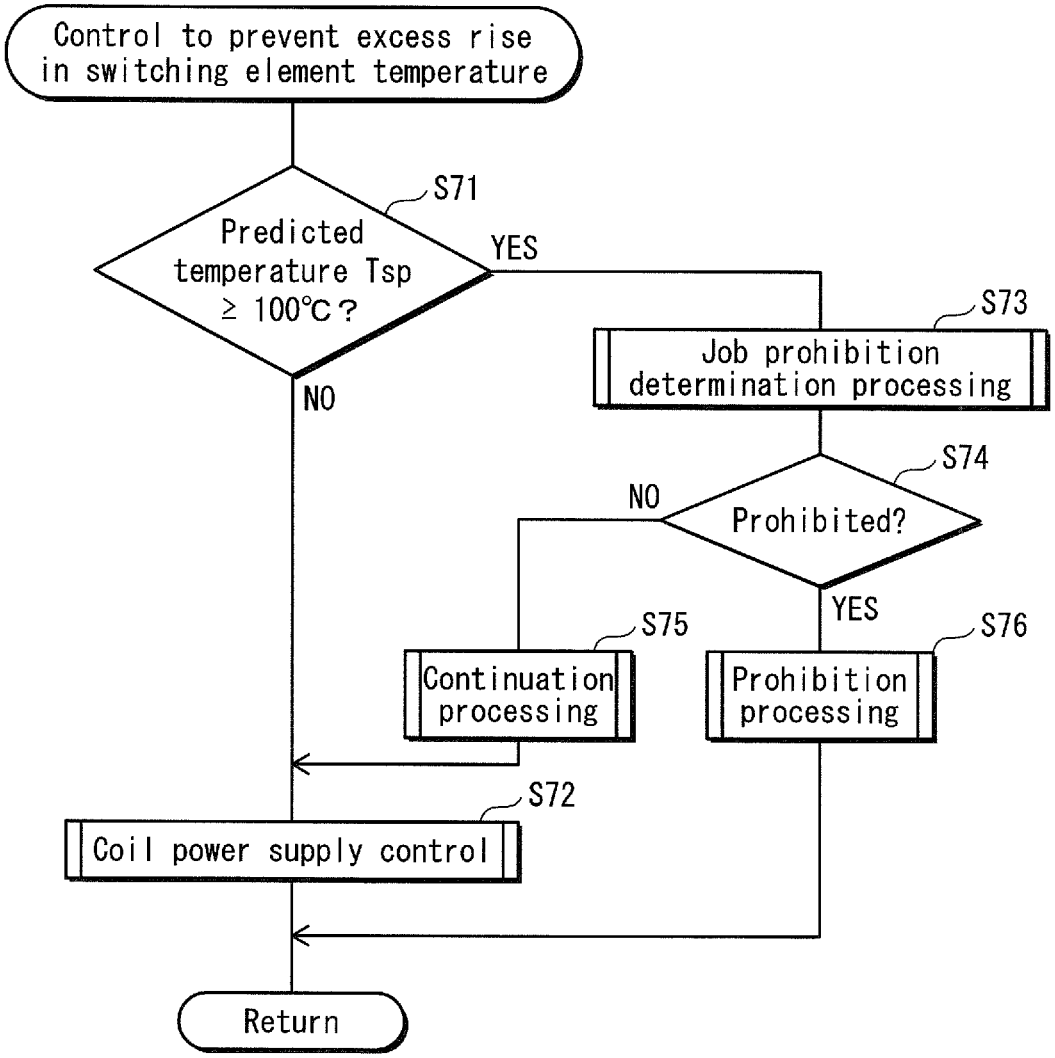
FIG. 19 is a flowchart showing the content of control to prevent an excess rise in switching element temperature.

(7-2-2) Content of Control to Prevent an Excess Rise in Switching Element Temperature FIG. 19 is a flowchart showing the content of a subroutine for control to prevent an excess rise in switching element temperature. The power control unit 67 performs this control.

As shown in FIG. 19, it is determined whether the predicted temperature Tsp is at least 100° C. (step S71).

If it is determined that the predicted temperature Tsp is not at least 100° C., i.e. if 80° C.≤the predicted temperature Tsp<100° C. (step S71: NO), then coil power supply control is performed (step S72), and processing returns. The coil power supply control corresponds to the above-described first control. The coil power supply control and the image formation operations are performed in parallel.

If the predicted temperature Tsp is determined to be at least 100° C. (step S71: YES), then job prohibition determination processing is performed (step S73). Job prohibition determination processing is processing to determine whether to continue or prohibit image formation operations after temporarily suspending image formation operations when the predicted temperature Tsp is at least 100° C.

Upon determining to continue the job (step S74: NO), continuation processing is performed (step S75), and coil power supply control is performed (step S72). Conversely, if it is determined to prohibit the job (step S74: YES), then prohibition processing is performed (step S76), and processing returns. The control from the job prohibition determination processing (step S73) to the prohibition processing (step S76) corresponds to the above-described second control.

Note that the coil power supply control (step S72) is performed after determining, as shown in FIG. 12, that the prediction point has been arrived at (step S12: YES) and after the switching element temperature prediction processing shown in FIG. 15 (step S41). While the time required from the determination that the prediction point has been arrived at until the start of the coil power supply control depends on as the processing speed of the IC in the CPU or the like provided in the control unit 3, this time is at most a few milliseconds. Therefore, this time can be ignored without affecting the fixing temperature control. Accordingly, in this embodiment, the starting time of the coil power supply control is considered to be simultaneous with the prediction point. This is true as well for the job prohibition determination processing (step S73).

(7-2-3) Content of Coil Power Supply Control Processing

Figure 20:
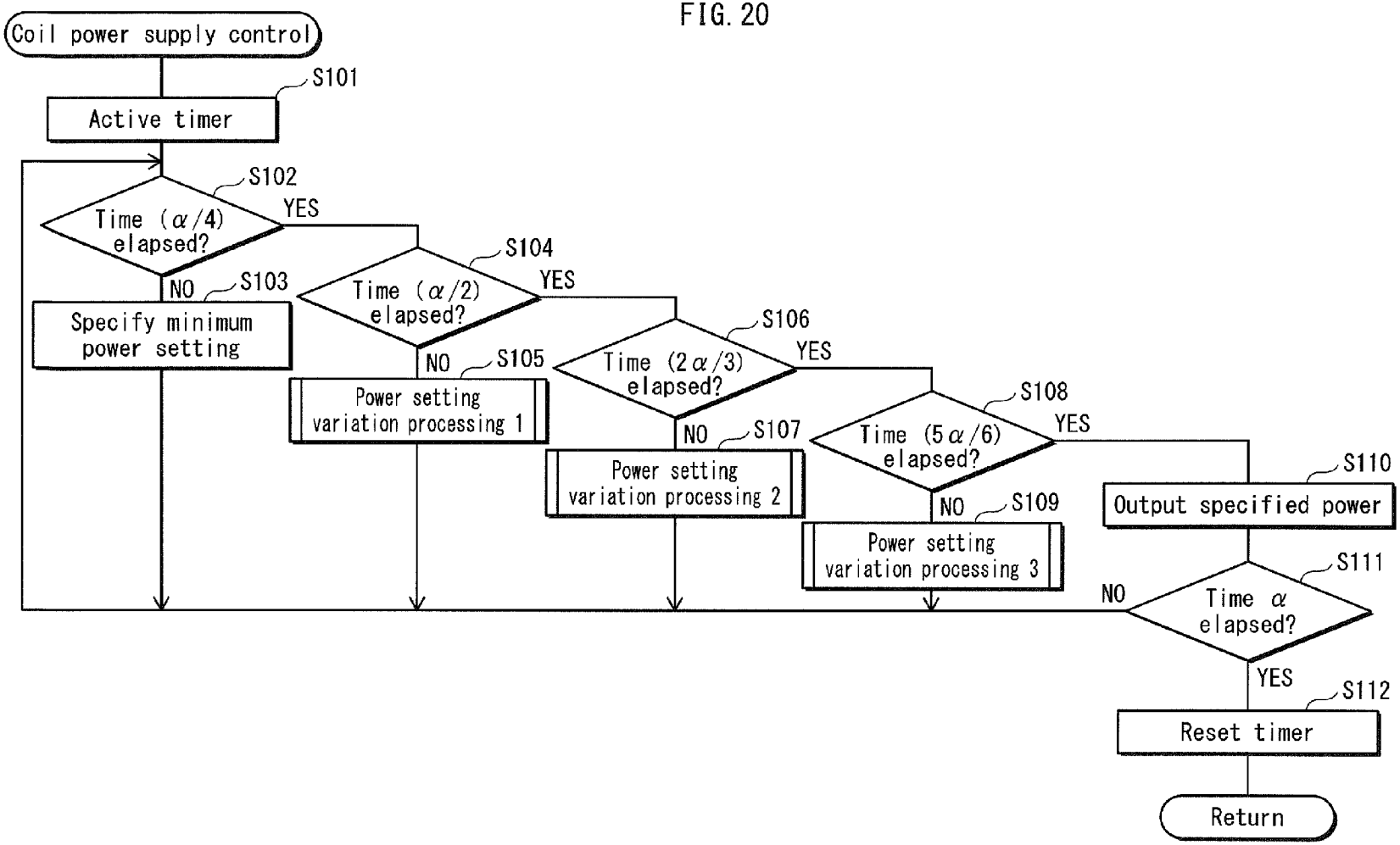
FIG. 20 is a flowchart showing the content of coil power supply control processing.

FIG. 20 is a flowchart showing the content of a subroutine for coil power supply control processing. As shown in FIG. 20, the second timer 59 is activated (step S101), and processing proceeds to step S102. Subsequently, the time elapsed since the prediction point ta can be ascertained by referring to the counter of the second timer 59.

In step S102, it is determined whether a time ($\alpha/4$) has passed from the prediction point ta. This time ($\alpha/4$) corresponds to the time from the prediction point ta to the time point to in FIG. 17.

If it is determined that the time ($\alpha/4$) has not yet elapsed (step S102: NO), then the minimum power setting is specified to the IH control unit 88 as the specified power (step S103), and processing returns to step S102.

In this context, the minimum power setting refers to the power necessary to maintain the fixing roller temperature at a minimum temperature, such as approximately 50° C. This minimum power falls within the range over which the power supplied to the excitation coil 131 can vary, such as 0 W to 1500 W, and is for example approximately 100 W. The reason for not cutting the power supply off by setting the minimum power setting to 0 W is as follows.

By cutting the power supply off, the fixing roller temperature would drop greatly, and the gap between the temperature necessary for fixing would grow large. As a result, after the start of the power supply, it can be assumed that the time necessary to increase the fixing roller temperature to the temperature necessary for fixing at the sheet arrival point tb would increase. Note that the minimum power setting varies according to the structure of the fixing unit 2. In the case that the time required to raise the fixing roller temperature to the temperature necessary for fixing is short, the power supply may be cut off, and the switching of the switching element 86 may be completely stopped. Cooling due to heat discharge by the switching element 86 can thus be promoted.

The IH control unit 88 controls switching of the switching element 86 so that the specified power as specified by the fixing temperature control unit 57 is supplied to the excitation coil 131, in this case power at the minimum power setting. In the case of the minimum power setting, the duty ratio of switching is also a minimum, and therefore if the switching element 86 is operating normally (i.e. has not short circuited or malfunctioned), the temperature of the switching element 86 starts to decrease (see the alternating long and short dashed line Q in FIG. 4A).

The processing in steps S102 and S103 is repeated from the prediction point ta until the elapsed time reaches ($\alpha/4$), and power at the minimum power setting is continually supplied to the excitation coil 131 (see the interval of time ($\alpha/4$) in FIG. 17). As a result, the temperature of the switching element 86 continues to decrease.

Upon determining that the time ($\alpha/4$) has elapsed (step S102: YES), it is determined whether the time ($\alpha/2$) has elapsed (step S104).

If it is determined that the time ($\alpha/2$) has not yet elapsed (step S104: NO), then power setting variation processing 1 is performed (step S105), and processing returns to step S102.

Figure 21:
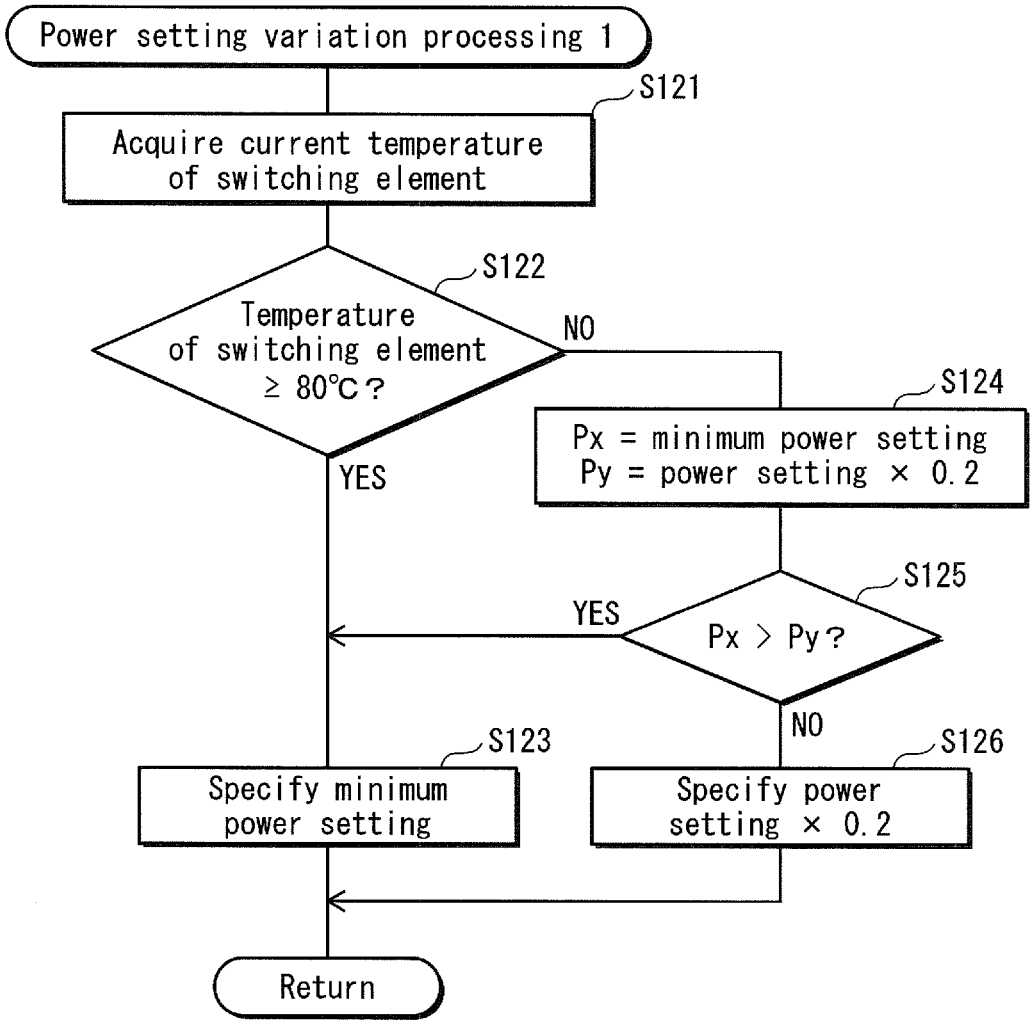
FIG. 21 is a flowchart showing the content of power setting variation processing 1.

FIG. 21 is a flowchart showing the content of a subroutine for power setting variation processing 1.

As shown in FIG. 21, during the power setting variation processing 1, the current temperature of the switching element 86 (measured value) is first acquired (step S121), and it is determined whether the temperature of the switching element 86 is at least 80° C. (step S122).

If it is determined that the temperature of the switching element 86 is at least 80° C. (step S122: YES), then the minimum power setting is specified to the IH control unit 88 as the specified power (step S123), and processing returns.

The current time point is in a time slot extending from a point after the prediction point ta at which the time ($\alpha/4$) has elapsed until a point immediately before the time ($\alpha/2$) is reached. A temperature of 80° C. or greater for the switching element 86 during this time slot means that the temperature of the switching element 86 is still high. Therefore, in order to lower the temperature further, the minimum power setting is specified.

If the temperature of the switching element 86 is determined not to be at least 80° C., i.e. to be less than 80° C. (step S122: NO), then a variable Px is set to the minimum power setting, and a variable Py is set to the power setting multiplied by 0.2 (step S124).

This power setting indicates the power supplied to the coil, set in advance for the fixing roller temperature as described above, and is a control value used during regular control. Information associating the fixing roller temperature and the power setting is stored in advance in the ROM 53. The power setting for the current fixing roller temperature can be acquired by acquiring the current fixing roller temperature and then reading the power setting corresponding to the acquired fixing roller temperature from the information stored in the ROM 53.

The reason for multiplying the power setting by a predetermined coefficient, which is 0.2 in this embodiment, is as follows.

From the prediction point ta until a time ($\alpha/4$) elapses, only power equivalent to the minimum power setting is supplied to the excitation coil 131. Therefore, at the present time, the fixing roller temperature should have decreased considerably. In order to quickly raise this decreased fixing roller temperature to the temperature range necessary for fixing, a somewhat large value is chosen as the power setting. If this large amount of power is supplied during this time slot, however, the temperature of the switching element 86 may begin to increase.

Therefore, instead of specifying the power setting, the power setting is multiplied by a predetermined coefficient (larger than zero and smaller than one) in order to suppress the power supplied to the excitation coil 131 to a certain degree.

At this point, since the time elapsed from the prediction point ta is not yet ($\alpha/2$), even if the temperature of the switching element 86 is less than 80° C., it can be assumed that the temperature is near 80° C. Therefore, the coefficient is set at 0.2 in order to greatly reduce the power supply.

In step S125, the magnitudes of Px and Py are compared. If Px>Py (step S125: YES), then Px (the minimum power setting) is specified to the IH control unit 88 as the specified power (step S123), and processing returns. On the other hand, if the relationship Px>Py is not true, i.e. if Px≤Py (step S125: NO), then Py (the power setting×0.2) is specified to the IH control unit 88 as the specified power (step S126), and processing returns.

The reason for specifying the larger of Px and Py as the specified power is the same as the reason for establishing the minimum power setting as described above: to gradually raise the fixing roller temperature by selecting the larger of the values, while ensuring that the fixing roller temperature does not fall below a minimum temperature.

The power setting variation processing 1 is repeatedly performed during the time slot extending from the time (α/4) until the time (α/2) after the prediction point to (the interval between time points to and tf in FIG. 17). As a result, if the temperature of the switching element 86 remains 80° C. or greater, then the power supplied to the excitation coil 131 is maintained at a low level to lower the temperature of the switching element 86. Conversely, if the temperature of the switching element 86 is less than 80° C., the fixing roller temperature is gradually caused to rise while preventing the temperature of the switching element 86 from rising.

Returning to FIG. 20, upon determining that the time (α/2) has elapsed (step S104: YES), it is determined whether a time (2α/3) has elapsed (step S106).

If it is determined that the time (2α/3) has not yet elapsed (step S106: NO), then power setting variation processing 2 is performed (step S107), and processing returns to step S102.

Figure 22:
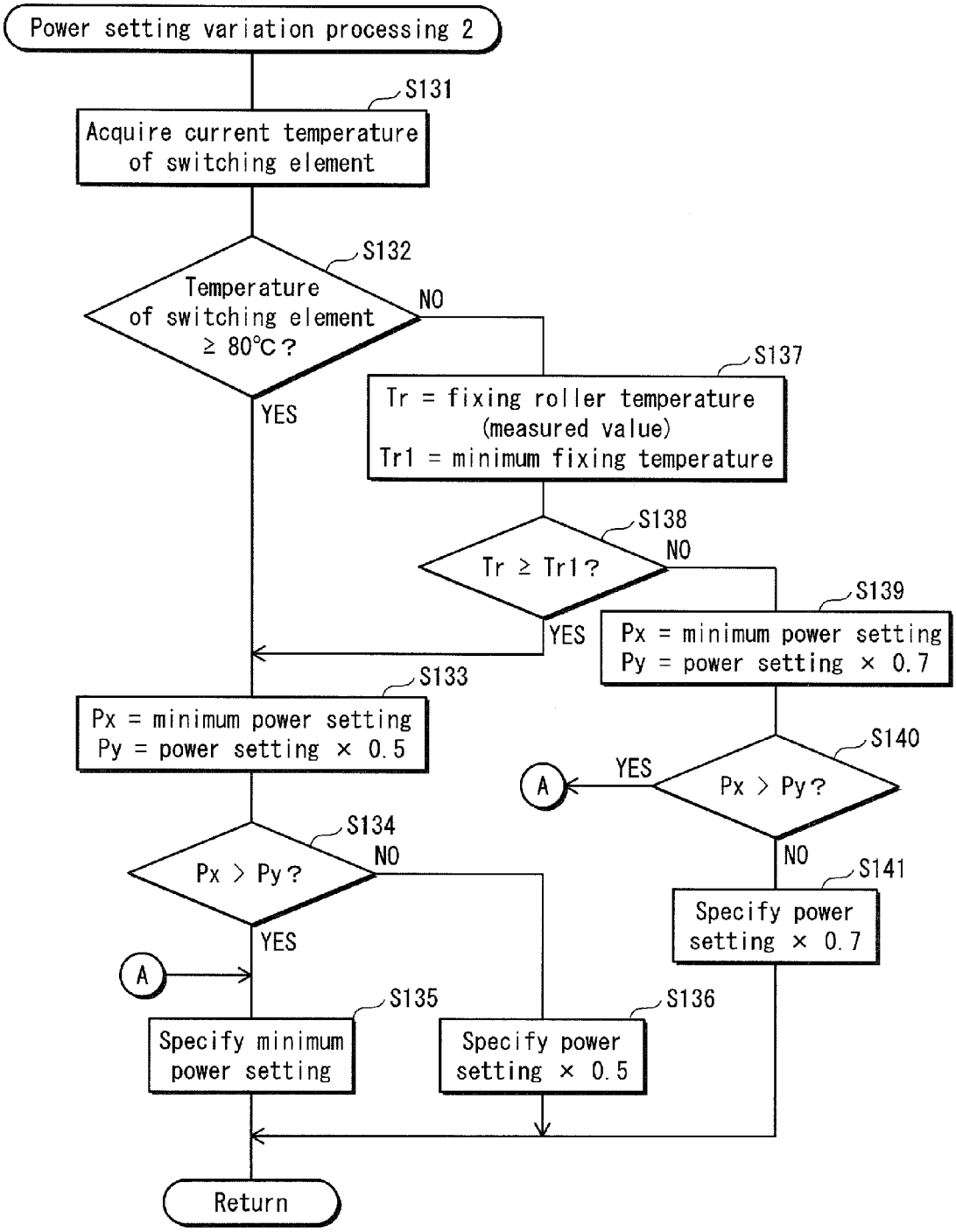
FIG. 22 is a flowchart showing the content of power setting variation processing 2.

FIG. 22 is a flowchart showing the content of a subroutine for power setting variation processing 2.

As shown in FIG. 22, during the power setting variation processing 2, the current temperature of the switching element 86 (measured value) is acquired (step S131), and it is determined whether the temperature of the switching element 86 is at least 80° C. (step S132).

If the temperature of the switching element 86 is determined to be at least 80° C. (step S132: YES), then the variable Px is set to the minimum power setting, and the variable Py is set to the power setting multiplied by 0.5 (step S133). This power setting corresponds to the current fixing roller temperature. As during power setting variation processing 1, this power setting is read from the ROM 53. The read power setting is multiplied by a predetermined coefficient, in this case 0.5, to yield the setting for Py. This method of setting Py is similarly applied to the method of setting Py described below.

If Px>Py (step S134: YES), then Px (the minimum power setting) is specified to the IH control unit 88 as the specified power (step S135), and processing returns.

If Px≤Py (step S134: NO), then Py (the power setting×0.5) is specified to the IH control unit 88 as the specified power (step S136), and processing returns.

The larger specified power between Px and Py is chosen for the same reason as above.

At the current time, even if the temperature of the switching element 86 is 80° C. or greater, the specified power should have been greatly suppressed up until this point. Therefore, it can be assumed that the temperature of the switching element 86 is tending to decrease even if the temperature is still 80° C. or greater, and that the temperature will not begin to increase even if the coefficient is made slightly larger. Therefore, during power setting variation processing 2, a larger value than the coefficient during power setting variation processing 1 (0.2) is set so that the fixing roller temperature will not fall too low. In this case, a value of 0.5 is used.

If the fixing roller temperature is high at this point, the power setting corresponding to the high temperature is a low value. Therefore, even if a somewhat large coefficient is used, since the power setting itself is low, the resulting specified power will not be a large value, thus preventing the fixing roller temperature from rising too much.

In step S132, if it is determined that the temperature of the switching element 86 is less than 80° C. (step S132: NO), then a variable Tr is set to the fixing roller temperature, and a variable Tr1 is set to a minimum fixing temperature (step S137). The fixing roller temperature is the current fixing roller temperature (measured value). The minimum fixing temperature is the lower limit of the temperature range necessary for fixing and is determined in advance. If the temperature range necessary for fixing is from 175° C. to 185° C., then the minimum fixing temperature is 175° C., and the maximum fixing temperature is 185° C.

If Tr≥Tr1 (step S138: YES), then processing proceeds to step S133. If Tr≥Tr1, then the current fixing roller temperature is already equal to or greater than the minimum fixing temperature. If too much power is supplied to the excitation coil 131, the temperature might exceed the maximum fixing temperature. Therefore, processing proceeds to step S133 in order to suppress the supplied power.

On the other hand, if Tr<Tr1 (step S138: NO), then the variable Px is set to the minimum power setting, and the variable Py is set to the power setting multiplied by 0.7 (step S139).

If Px>Py (step S140: YES), then processing proceeds to step S135. If Px≤Py (step S140: NO), then Py (the power setting×0.7) is specified to the IH control unit 88 as the specified power (step S141), and processing returns. The larger of the settings Px and Py is thus specified as the specified power.

The power setting variation processing 2 is repeatedly performed during the time slot extending from the time (α/2) until the time (2α/3) after the prediction point to (the interval between time points tf and tg in FIG. 17).

As a result, if the temperature of the switching element 86 remains 80° C. or greater, then the power supplied to the excitation coil 131 is maintained at a low level to lower the temperature of the switching element 86. Conversely, if the temperature of the switching element 86 is less than 80° C., and the fixing roller temperature is also low, then the power supplied to the excitation coil 131 increases, as shown in the example in FIG. 17, since the coefficient by which the power setting is multiplied is larger than during power setting variation processing 1. Therefore, the fixing roller temperature is caused to rise towards the temperature range necessary for fixing.

Returning to FIG. 20, upon determining that the time (2α/3) has elapsed (step S106: YES), it is determined whether a time (5α/6) has elapsed (step S108).

If it is determined that the time (5α/6) has not yet elapsed (step S108: NO), then power setting variation processing 3 is performed (step S109), and processing returns to step S102.

Figure 23:
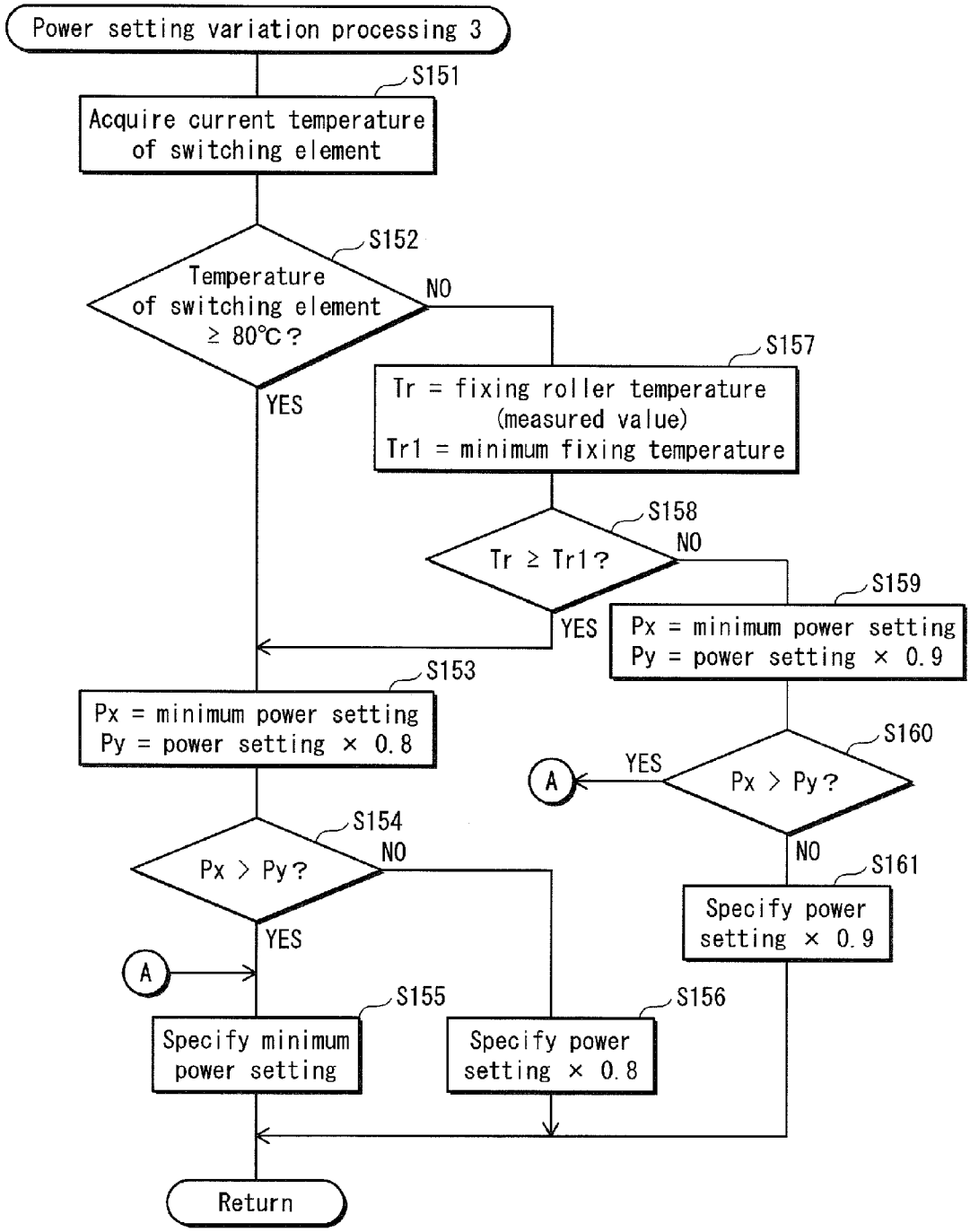
FIG. 23 is a flowchart showing the content of power setting variation processing 3.

FIG. 23 is a flowchart showing the content of a subroutine for power setting variation processing 3.

As shown in FIG. 23, during the power setting variation processing 3, the current temperature of the switching element 86 (measured value) is acquired (step S151), and it is determined whether the temperature of the switching element 86 is at least 80° C. (step S152).

If the temperature of the switching element 86 is determined to be at least 80° C. (step S152: YES), then the variable Px is set to the minimum power setting, and the variable Py is set to the power setting multiplied by 0.8 (step S153).

If Px>Py (step S154: YES), then Px (the minimum power setting) is specified to the IH control unit 88 as the specified power (step S155), and processing returns.

If Px≤Py (step S154: NO), then Py (the power setting×0.8) is specified to the IH control unit 88 as the specified power (step S156), and processing returns.

Note that the coefficient is a larger value than during power setting variation processing 2. As above, however, if the temperature of the switching element 86 and the fixing roller temperature are both high, then since the power setting itself is a low value, the fixing roller temperature is prevented from rising too much.

If it is determined that the temperature of the switching element 86 is less than 80° C. (step S152: NO), then the variable Tr is set to the fixing roller temperature, and the variable Tr1 is set to the minimum fixing temperature (step S157). As in power setting variation processing 2, the fixing roller temperature is the current fixing roller temperature (measured value).

If Tr≥Tr1 (step S158: YES), then processing proceeds to step S153. As during power setting variation processing 2, since the current fixing roller temperature is already equal to or greater than the minimum fixing temperature, the maximum fixing temperature may be exceeded if too much power is supplied to the excitation coil 131.

If Tr<Tr1 (step S158: NO), then the variable Px is set to the minimum power setting, and the variable Py is set to the power setting multiplied by 0.9 (step S159).

If Px>Py (step S160: YES), then processing proceeds to step S155. If Px≤Py (step S160: NO), then Py (the power setting×0.9) is specified to the IH control unit 88 as the specified power (step S161), and processing returns. The larger of the settings Px and Py is thus specified as the specified power.

The power setting variation processing 3 is repeatedly performed during the time slot extending from the time (2α/3) until the time (5α/6) after the prediction point to (the interval between time points tg and th in FIG. 17). As a result, if the temperature of the switching element 86 remains 80° C. or greater, then the power supplied to the excitation coil 131 is maintained at a low level to lower the temperature of the switching element 86. Conversely, if the temperature of the switching element 86 is less than 80° C., and the fixing roller temperature is still low, then the power supplied to the excitation coil 131 increases even more, as shown in the example in FIG. 17, since the coefficient by which the power setting is multiplied is larger than during power setting variation processing 2. Therefore, the fixing roller temperature is caused to rise towards the temperature range necessary for fixing.

Returning to FIG. 20, upon determining that the time (5α/6) has elapsed (step S108: YES), the power setting for the current fixing roller temperature is specified to the IH control unit 88 as the specified power (step S110). Using the power setting as is as the specified power corresponds to setting the above coefficient to one. If the time α has not yet elapsed (step S111: NO), processing returns to step S102.

This specification of the power setting as the specified power is repeated during the during the time slot extending from the time (5α/6) until the time α after the prediction point to (the interval between time points th and tb in FIG. 17). After the time (5α/6) has elapsed, the power setting for the fixing roller temperature (measured value) is used as is as the specified power. Therefore, if the fixing roller temperature is lower than the minimum fixing temperature, the power supplied to the excitation coil 131 increases. Conversely, if the fixing roller temperature is higher than the maximum fixing temperature, the supplied power is reduced, so that by the time the sheet arrival point tb is reached, the fixing roller temperature will fall within the temperature range necessary for fixing.

The sheet arrival point tb is equivalent to the point at which the tip of the sheet S reaches the fixing nip N. Therefore, by controlling the fixing roller temperature to fall within the temperature range necessary for fixing, the sheet S can be adequately fixed.

Note that it suffices to control the power supplied to the coil, i.e. the power supplied to the switching element 86, so that the fixing roller temperature falls within the temperature range necessary for fixing at the sheet arrival point tb. Factors such as the elapsed times, the coefficients by which the power settings are multiplied, and the like are not limited to the above values.

Furthermore, whereas the time α from the prediction point ta until the sheet arrival point tb is divided into five time slots above, with a specified power determined for each time slot, the number of time slots is not limited in this way and may be smaller or greater than five. If the number of time slots is larger, the specified power may be determined with greater precision during the time α in order to control the power supplied to the coil.

Upon determining that the time α has been reached (step S111: YES), the second timer 59 is reset (step S112), and processing returns.

(7-2-4) Content of Job Prohibition Determination Processing

Figure 24:
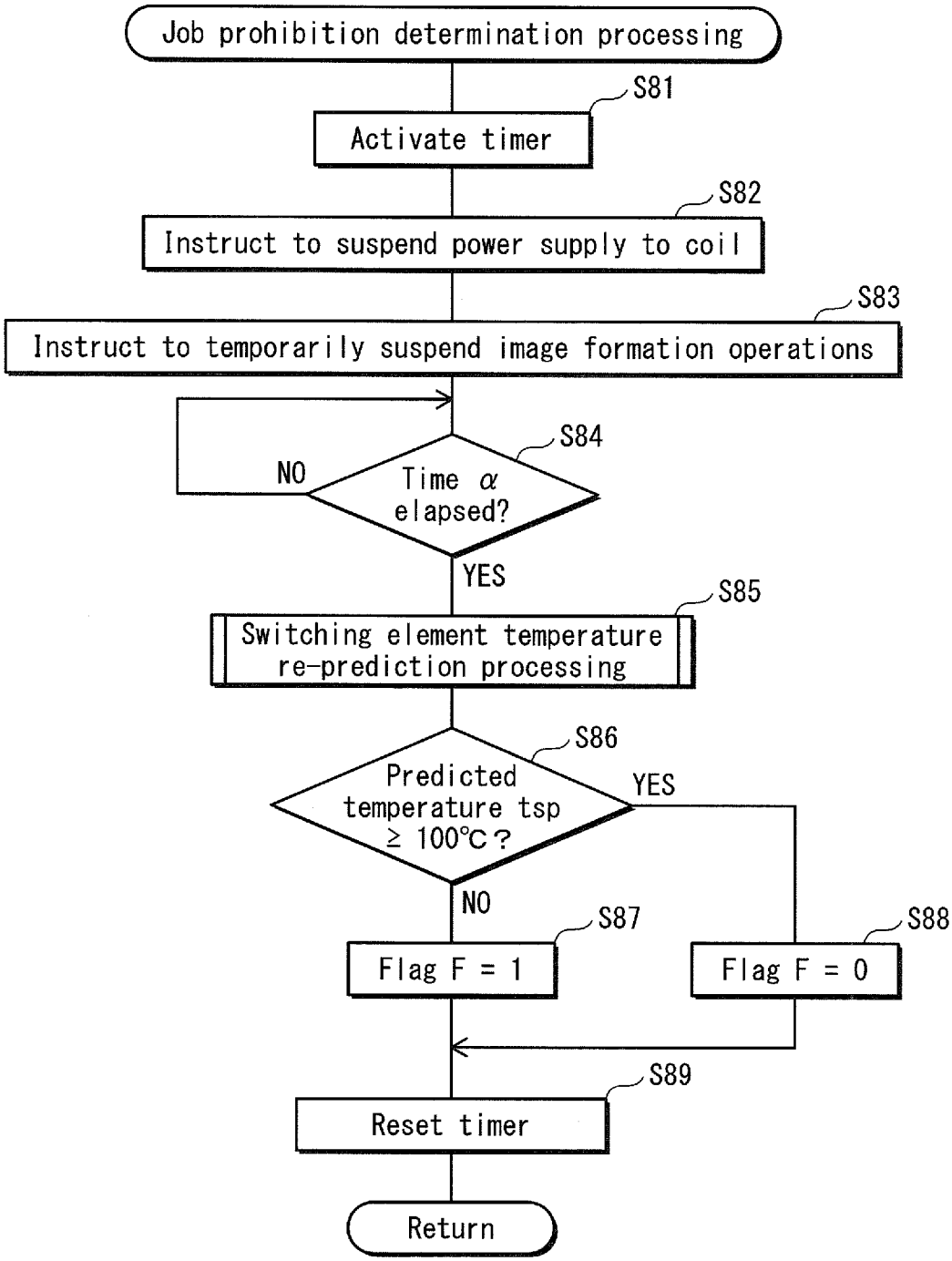
FIG. 24 is a flowchart showing the content of job prohibition determination processing.

FIG. 24 is a flowchart showing the content of a subroutine for job prohibition determination processing.

As shown in FIG. 24, the second timer 59 is activated (step S81). Subsequently, the time elapsed since the prediction point ta can be ascertained by referring to the counter of the second timer 59.

The IH control unit 88 is instructed to suspend the power supply to the excitation coil 131 (step S82). This instruction to suspend the power supply is performed by transmitting information indicating power supply suspension. Upon receiving the instruction to suspend the power supply, the IH control unit 88 immediately instructs the drive circuit 87 to stop switching of the switching element 86. If the switching element 86 and the drive circuit 87 are operating normally, switching of the switching element 86 is suspended. Therefore, the temperature of the switching element 86 decreases.

Note that as above, the switching element temperature detection processing is regularly performed while the power is turned on. Therefore, the temperature of the switching element 86 is detected at predetermined intervals during the job prohibition determination processing as well, and the detected temperature is written in the corresponding information table 62 as history. Accordingly, at any given point during the job prohibition determination processing as well, the rate of change (change in temperature) of the switching element 86 from a time point in the past until the given point can be calculated.

Subsequently, the print control unit 56 is instructed to temporarily suspend the image formation operations (step S83). Since the prediction point ta is immediately before the start of the image formation operations (the start of exposure or the start of transportation for registration), as described above, the image formation operations have not yet started at this time point. It is thus possible to issue the instruction to temporarily suspend operations.

Upon receiving the instruction to temporarily suspend the image formation operations, the print control unit 56 temporarily suspends the start of the image formation operations. As a result, during color mode, the start of Y-color exposure is suspended. During monochrome mode, the start of transportation for registration of the sheet S is suspended. Note that temporarily suspending the start of the image formation operations means that not only exposure or transportation of the sheet S is suspended. Rather, all processes, such as charging, development, transfer, and the like are suspended.

It is determined whether the time elapsed since the prediction point ta has reached the time α (step S84). If the elapsed time reaches the time α without processing proceeding to step S85 (step S84: NO), then the temperature of the switching element 86 should decrease until reaching the time α, since an instruction to suspend switching of the switching element 86 has been issued.

When it is determined that the time α has been reached (step S84: YES), switching element temperature re-prediction processing is performed (step S85).

Switching element temperature re-prediction processing (hereinafter referred to as "re-prediction processing") is basically the same as the above switching element temperature prediction processing (step S41). During the switching element temperature prediction processing, the prediction is made at the prediction point ta. On the other hand, during re-prediction processing, a new prediction point occurring when the time α elapses after the prediction point ta is selected, and a prediction is made at this new prediction point.

As above, the sheet arrival point tb is a point occurring when the time α elapses after the prediction point. Therefore, the time points ta, tb, tc, and td are all shifted to be later by the time α, and the same processing as during the switching element temperature prediction processing is performed as re-prediction processing. In terms of the conceptual diagram in FIG. 6C, the second time point corresponds to a new prediction point ta, and the third time point corresponds to a new sheet arrival point tb (time targeted for prediction).

By performing the re-prediction processing (step S85), the predicted temperature determined during the switching element temperature prediction processing (step S41) is updated to the predicted temperature determined during the re-prediction processing.

It is determined whether the predicted temperature Tsp of the switching element 86 determined during re-prediction processing is at least 100° C. (step S86).

Upon determining that the predicted temperature Tsp of the switching element 86 is less than 100° C. (step S86: NO), a flag F is set to one (step S87), and processing proceeds to step S89. On the other hand, upon determining that the predicted temperature Tsp of the switching element 86 is at least 100° C. (step S86: YES), the flag F is set to zero (step S88), and processing proceeds to step S89. The flag F is used during step S74 of FIG. 19 as information indicating whether the job X is to be prohibited or continued. If the flag F is one, it is determined that the job X is to be continued, whereas if the flag F is zero, it is determined that the job X is to be prohibited.

During step S89, after resetting the second timer 59, processing returns.

Note that above, the re-prediction processing of step S85 is described as being performed when the time α has elapsed after the prediction point ta. The timing of the re-prediction processing is not, however, limited in this way. Any timing appropriate for re-predicting the temperature of the switching element 86 may be chosen. For example, the temperature may be re-predicted when the time (α/2) has elapsed, or when the time 2α has elapsed. As the time before performing the re-prediction processing grows longer, a longer time can be provided for the temperature of the switching element 86 to decrease. Resumption of the image formation operations, however, is correspondingly delayed. Therefore, the length of the time before the re-prediction processing is determined by weighing the decrease in temperature of the switching element 86 against the delay in the start of image formation operations.

(7-2-5) Content of Continuation Processing

Figure 25:
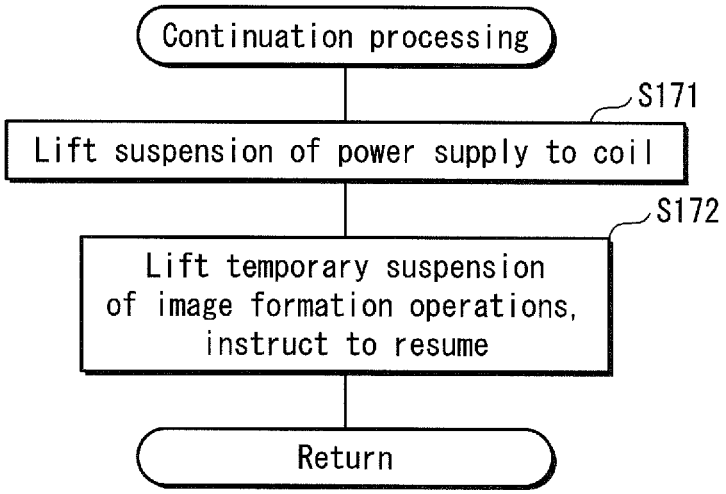
FIG. 25 is a flowchart showing the content of continuation processing.

FIG. 25 is a flowchart showing the content of a subroutine for continuation processing.

As shown in FIG. 25, suspension of the power supply to the excitation coil 131 is lifted (step S171). This is done by instructing the IH control unit 88 to lift the temporary suspension. Upon receiving the instruction to lift the temporary suspension, the IH control unit 88 starts supplying power to the excitation coil 131 again based on the specified power from the fixing temperature control unit 57. Control then returns to the same control as before the temporary suspension.

The print control unit 56 is instructed to resume the image formation operations for job X by lifting the temporary suspension of image formation operations (step S172), and processing returns.

Upon receiving these instructions, the print control unit 56 resumes the image formation operations for job X by lifting the temporary suspension of image formation operations.

Note that the start of coil power supply control and of image formation operations occurs immediately after reaching the new prediction point (when the result of step S84 in FIG. 24 is YES). While the processing time required from the point at which the new prediction point is reached until the instruction to start coil power supply control and image formation operations is issued depends on the processing speed of the control unit 3, this time is at most a few milliseconds. Therefore, in this embodiment, the starting time of image formation operations and the starting time of coil power supply control are considered to be simultaneous with the new prediction point.

After the continuation processing in FIG. 19 (step S75), when the coil power supply control (step S72) is performed, the power supplied to the excitation coil 131 is controlled by the coil power supply control shown in FIG. 20 in parallel with the image formation operations until a time point (new sheet arrival point) at which the time α has elapsed since the new prediction point. As a result, the fixing roller temperature is raised to fall within the temperature range necessary for fixing by the time the new sheet arrival point is reached. Performance of the job X can thus be continued.

The sheet arrival point is equivalent to the point at which the tip of the sheet S reaches the fixing nip N. Therefore, since the fixing roller temperature falls within the temperature range necessary for fixing, the sheet S can be adequately fixed.

(7-2-6) Content of Prohibition Processing

Figure 26:
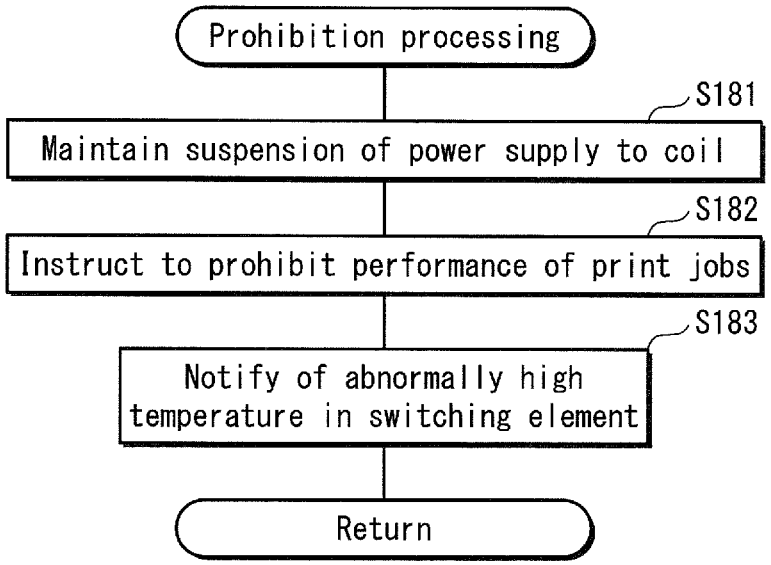
FIG. 26 is a flowchart showing the content of prohibition processing.

FIG. 26 is a flowchart showing the content of a subroutine for prohibition processing.

As shown in FIG. 26, the temporary suspension of power supply to the excitation coil 131 is maintained (step S181). The print control unit 56 is then instructed to prohibit performance of print jobs (step S182), and the CPU 52 is notified of an abnormally high temperature in the switching element 86 (step S183). Processing then returns.

Prohibition processing is performed when the predicted temperature is at least 100° C. even after temporarily suspending the job X and guaranteeing time to lower the temperature of the switching element 86. The switching element 86 or the drive circuit 87, for example, may have failed.

Upon receiving the instruction to prohibit performance of print jobs, the print control unit 56 lifts the temporary suspension and prohibits the performance of all print jobs until receiving an instruction to lift the prohibition. Upon receiving notification of an abnormally high temperature in the switching element 86, the CPU 52 notifies the user of the abnormality in the switching element 86 by displaying a warning message or the like on the liquid crystal display of the operation panel 4.

Once the abnormality of the switching element 86 has been resolved, for example by a repair technician, the temporary suspension of power supply to the excitation coil 131 is lifted, and the prohibition of performance of print jobs is also lifted so as to return to a state in which print jobs can be performed. In this case, the job X may be kept in a pending state during the prohibition of print jobs, and upon the return to the state in which print jobs can be performed, the job X may be removed from the pending state and performed again from the start. Alternatively, the job X may be canceled when print jobs are prohibited.

As described above, when the predicted temperature of the switching element 86 is at least a first temperature Ts1, which is a predetermined temperature, then even if the actual temperature of the switching element 86 at the prediction point ta is less than the first temperature Ts1, the temperature will continue to rise if no measures are taken, thus making it highly probable that the temperature will be at least the first temperature Ts1 at the sheet arrival point tb. Therefore, starting at the prediction point ta, the switching of the switching element 86 is restricted to lower the temperature of the switching element 86.

Subsequently, the restriction on the switching is lifted, and the power supply to the excitation coil 131 is controlled so that the fixing roller temperature will reach the temperature necessary for fixing by the time the sheet arrival point tb is reached. Note that this control includes not only increasing the power supply to the excitation coil 131 after lifting the restriction on switching, but also reducing the power supply to the excitation coil 131 when the fixing roller temperature is high.

By performing the above control, an excessive rise in temperature of the switching element 86 can be prevented, as can a reduction in fixity of a sheet S passing through the fixing nip N.

Furthermore, since the future temperature of the switching element 86 is predicted immediately before the start of the image formation operations, the start of the image formation operations can be temporarily suspended and the switching of the switching element 86 can be immediately restricted when the predicted temperature of the switching element 86 exceeds an upper limit. This allows for the start of image formation operations to be postponed until the temperature of the switching element 86 lowers.

When the predicted temperature of the switching element 86 exceeds the upper limit (Ts2), it may be assumed that conditions allow for the temperature of the switching element 86 to easily rise. For example, if the temperature at the location where the printer is installed suddenly rises from a low to a high temperature, the temperature inside the printer also rises as a result. Therefore, the temperature around the IH power supply drive unit 80 provided within the printer also rises.

A low temperature surrounding the IH power supply drive unit 80 promotes heat radiation by the switching element 86, and therefore the temperature of the switching element 86 easily lowers. Conversely, a high surrounding temperature makes it difficult for the temperature of the switching element 86 to decrease. Accordingly, the temperature of the switching element 86 may not immediately lower even by restricting switching of the switching element 86. In order to lower the temperature of the switching element 86, a certain amount of time thus becomes necessary.

For example, when the temperature of the switching element 86 is predicted after the start of the image formation operations, then even if switching of the switching element 86 is restricted immediately after predicting the temperature, it may nevertheless take time for the temperature of the switching element 86 to transition from rising to decreasing. At the point at which the tip of the sheet S reaches the fixing nip N, the restriction on switching may not yet have been lifted.

If the restriction on switching is still in place, the fixing roller temperature can be expected to be low. The sheet S may therefore not be provided with the heat necessary for fixing, and such insufficient heat fixing may lead to defective fixing.

If, on the other hand, the temperature of the switching element 86 is predicted immediately before the start of the image formation operations, then the start of the image formation operations can be temporarily suspended. Therefore, even if it takes time for the temperature of the switching element 86 to lower, the above-described defective fixing can be prevented by starting the image formation operations after the temperature of the switching element 86 lowers.

Note that even if the temperature of the switching element 86 is predicted after the start of image formation operations, depending on the structure of the apparatus it may be possible in some cases to lower the temperature of the switching element 86 immediately by restricting switching of the switching element 86. In light of this, the prediction of the temperature of the switching element 86 is not limited to being performed immediately before the start of the image formation operations. For example, the temperature of the switching element 86 may be predicted immediately after the start of the image formation operations. In other words, the prediction of the temperature of the switching element 86 and the start of the image formation operations may be simultaneous, or the order of the two may be reversed.

In the above description, the prediction point at which the future temperature of the switching element 86 is predicted is described as being a few milliseconds before the start of the image formation operations, but the prediction point is not limited in this way. For example, the prediction point may be a few seconds earlier. If prediction of the temperature is made too early before the start of the image formation operations, however, the temperature information on the past change in temperature used for temperature prediction is older than when prediction is made immediately before the start of the image formation operations, specifically by the difference in time between the temperature prediction point and the time at which the image formation operations start. This makes it easy for the accuracy of the prediction point to decrease. Therefore, when the prediction point is set before the start of the image formation operations, it is preferable to set the prediction point to be immediately before the start of the image formation operations, defined as the nearest time point to the start of the image formation operations at which it is still possible to temporarily suspend the start of the image formation operations via a suspension instruction to the print unit 1.

One way to improve the accuracy of temperature prediction might be to set the prediction point to be a time point that is closer to the sheet arrival point within the interval from the start of the image formation operations to the sheet arrival point. Since the temperature of the switching element 86 at the sheet arrival point is predicted, making the prediction at a time point closer to the sheet arrival point would reduce error in the prediction results.

The fixing temperature control, however, not only includes making a prediction at the prediction point of the future temperature of the switching element 86, but also restricting the switching of the switching element 86 after the prediction point, subsequently lifting the restriction, and then controlling the amount of power supplied to the excitation coil 131 so that the fixing roller temperature reaches the temperature necessary for fixing by the time the sheet arrival point is reached. Therefore, if the time from the prediction point until the sheet arrival point is exceedingly short, it may be impossible to perform the fixing temperature control itself.

Therefore, the prediction point is set by performing experiments in accordance with the structure of the apparatus to calculate a range over which enough time to perform the above control is guaranteed while yielding acceptable accuracy in the temperature prediction results, and then selecting a time point within this range, such as the start of image formation operations or a time point immediately preceding or following the start.

The present invention is not limited to an image forming apparatus, but also includes an image forming method that performs the above fixing temperature control. This method may be a program to be executed by a computer. The program may be stored on a computer-readable recording medium such as magnetic tape; magnetic disks such as flexible disks; optical recording media such as a DVD-ROM, DVD-RAM, CD-ROM, CD-R, MO, PD, and the like; and flash memory related recording media. The recording medium may be mass produced and distributed. Furthermore, the program may be distributed over a variety of wireless or wired networks, including the Internet, or transmitted over telecommunications networks, by satellite communication, and the like.

<Modifications>

The present invention has been described based on the embodiment, but the present invention is of course in no way limited to the above embodiment. The following modifications are possible.

(1) In the above embodiment, the prediction point is chosen during prediction point determination processing in accordance with the mode of operations, i.e. color mode or monochrome mode. In a structure in which operations are only performed in one of these two modes, the prediction point corresponding to that mode may be determined in advance. In this case, therefore, a structure that does not perform prediction point determination processing may be adopted.

(2) In the above embodiment, the time required in color mode from the start of Y-color exposure until the tip of the image formed on the intermediate transfer belt 21 reaches the secondary transfer position 25 is the first time. In monochrome mode, the time required from the start of K-color exposure until the tip of the image formed on the intermediate transfer belt 21 reaches the secondary transfer position 25 is the second time. In either mode, the time required from the start of transportation for registration until the tip of the sheet S reaches the secondary transfer position 25 is the third time. Since the first time>the third time>the second time, in color mode the start of Y-color exposure is the time for the start of the image formation operations, and the prediction point is set to be immediately before the start of Y-color exposure. In monochrome mode, the start of transportation for registration is the time for the start of the image formation operations, and the prediction point is set to be immediately before the start of transportation for registration. If, for example, the second time<the third time, then in monochrome mode the prediction point is set to be immediately before the start of K-color exposure. If the first time=the third time, the prediction point may also be set to be immediately before the start of Y-color exposure.

(3) In the above embodiment, an example is described assuming that in color mode, the toner image is composed of colors Y through K. However, images may, for example, be formed with only colors other than Y, i.e. M, C, and K. In this case, the prediction point is set to be immediately before whichever of the following makes the above time longer: the start of M-color exposure by the image creating unit 10M, which is positioned furthest upstream along rotational direction of the intermediate transfer belt 21, and the start of transportation for registration. For image formation using colors C and K, the prediction point is similarly set to be immediately before whichever makes the above time longer: the start of C-color exposure, which is positioned furthest upstream, and the start of transportation for registration.

In other words, in color mode, the prediction point is set in advance to be either immediately before the start of exposure for the photoconductor drum positioned furthest upstream or immediately before the start of transportation, depending on which of the following times is longer: (i) the time required for an image formed at the exposure position of the photoconductor drum positioned furthest upstream, among the photoconductor drums 11Y through 11C that are in use, to undergo primary transfer to the intermediate transfer belt 21 at the primary transfer position of the photoconductor drum positioned furthest upstream, in addition to the time for the tip of the image that has undergone primary transfer to move, by rotation of the intermediate transfer belt 21, to the secondary transfer position 25, and (ii) the time from the start of transportation for registration of a sheet towards the secondary transfer position 25 until the tip of the sheet reaches the secondary transfer position 25.

With this structure, for each job in color mode, the prediction point can be switched between being immediately before the start of exposure for the photoconductor drum positioned furthest upstream and immediately before the start of transportation for registration by determining which of the photoconductor drums 11Y though 11C is the furthest upstream drum in use. Therefore, in any mode (i.e. no matter which image creating unit is further upstream), an excessive rise in temperature of the switching element 86 may be prevented while suppressing a reduction in fixity.

Note that methods of determining which photoconductor drum is positioned furthest upstream for image data of a print job to be performed include, for example, determining that (a) the photoconductor drum positioned furthest upstream is 11Y when data for Y-color image formation is included, (b) the photoconductor drum positioned furthest upstream is 11M when no Y-color data is included, yet M-color data is included, and (c) the photoconductor drum positioned furthest upstream is 11C when neither Y-color nor M-color data is included, yet C-color data is included.

(4) The start of transportation for registration refers to the time at which the pair of resist rollers 33 begins to transport a sheet S towards the secondary transfer position 25. In a structure in which no pair of resist rollers 33 is provided, however, and the timing of the start of transportation towards the secondary transfer position 25 is measured with reference to another transport member, such as the pick-up roller 31, then the prediction point may be set to be immediately before whichever makes the above time longer: the start of transportation of the sheet S by the other transport member, and the start of exposure. In this sense, the start of transportation for registration is not limited to the pair of resist rollers 33.

(5) In the above embodiment, an example of an image forming apparatus according to the present invention is described as a tandem-type color digital printer, but the present invention is not limited in this way. Regardless of whether image formation is color or monochrome, the present invention may be adopted in a copier, facsimile machine (FAX), Multiple Function Peripheral (MFP), or the like, as long as the image forming apparatus includes a fixing unit based on electromagnetic induction heating, the fixing unit fixes an unfixed image to a transported sheet by the heat of a fixing member, and the electromagnetic induction heating layer 121 provided in the sleeve 112 or the like as the fixing member is heated by magnetic flux generated by the excitation coil 131. The fixing member is not limited to a belt, but may also be a roller or a drum.

In the case of a monochrome image forming apparatus, an image formed on the photoconductor drum, which is an image carrier, is transferred to a transported sheet at the transfer position on the photoconductor drum. In this case, the time required from when the tip of the image formed on the surface of the photoconductor drum is at the exposure position on the photoconductor drum until the tip of the image reaches the transfer position in the rotational direction of the drum is the first time, and the time required from the start of transportation of the sheet that is transported towards the transfer position until the tip of the sheet S reaches the transfer position is the second time. If the first time≥the second time, the start of the image formation operations becomes the start of exposure, and the prediction point is set to be immediately before the start of exposure. If the first time<the second time, the start of the image formation operations becomes the start of transportation for registration, and the prediction point is set to be immediately before the start of transportation for registration.

As long as the image carrier has the function of carrying, on the surface thereof, an unfixed image composed of toner and the like, the image carrier is not limited to a photoconductor drum. The image carrier may, for example, be a photoconductor belt. The intermediate transfer belt 21, an example of an intermediate transfer body, can also be considered a type of image carrier. The intermediate transfer body is not limited to a belt, but may be a drum or another shape.

When the intermediate transfer body is considered an image carrier, then in the case of a tandem-type color image forming apparatus in which a plurality of photoconductors are arranged along the circumferential direction of the intermediate transfer body in series with intervals therebetween, the plurality of photoconductors and the intermediate transfer body may be considered to be included in the image carrier.

Furthermore, in the above embodiment, the control unit 3 and the IH control unit 88 are separate structures, but these may be integrated into one control unit, or the IH control unit 88 may be incorporated into the fixing temperature regulation unit 57. Note that the above values for the temperature, power, time, and the like are not limited to the above numerical values and are selected appropriately in accordance with the structure of the apparatus.

The above embodiment and modifications may be combined with one another.

SUMMARY

The above embodiment and modifications are one aspect of the present invention for solving the problems discussed in the Background Art. The above embodiment and modifications may be summarized as follows.

(1) An image forming apparatus according to an aspect of the present invention uses a switching element to switch current flowing to an excitation coil, so that the excitation coil generates magnetic flux that causes an electromagnetic induction heating layer in a fixing member to produce heat, the heat fixing an unfixed image formed on a transported sheet to the transported sheet, the image forming apparatus comprising: a detection unit configured to detect a temperature of the fixing member; a calculation unit configured to calculate a change in temperature of the switching element over time; a prediction unit configured to determine, at a first time point, a predicted temperature of the switching element at a second time point in accordance with the change in temperature of the switching element up until the first time point, the first time point being a predetermined time before the second time point, and the second time point being a time at which a tip of the sheet in a direction of transportation is scheduled to arrive at the fixing member; and a control unit configured to perform first control, from the first time point until the second time point, when the predicted temperature of the switching element is at least a predetermined value, the first control controlling power supplied to the excitation coil by restricting switching of the switching element and lifting the restriction, so that by the second time point the detected temperature of the fixing member reaches a temperature necessary for fixing.

(2) The image forming apparatus of (1) may further comprise a print unit configured to perform image formation operations to form an image on an image carrier, transport a sheet to a transfer position of the image carrier, transfer the image on the image carrier to the sheet at the transfer position as the unfixed image, and transport the sheet after image transfer to the fixing member. The first time point may be earlier than a start of the image formation operations. The control unit may be further configured to perform second control instead of the first control when the predicted temperature of the switching element is at least an upper limit that is higher than the predetermined value, the second control temporarily suspending the start of the image formation operations by the print unit and restricting switching of the switching element.

(3) In the image forming apparatus of (2), the first time point may be a predetermined time point that is a closest time point to the start of image formation operations at which the start of image formation operations is suspendable by an instruction to the print unit.

(4) In the image forming apparatus of (2), the prediction unit may be further configured to determine, at a time point A, a re-predicted temperature of the switching element at a time point B in accordance with the change in temperature of the switching element up until the time point A, the time point A being after the start of the image formation operations are temporarily suspended, and the time point B being a time at which the tip of the sheet in the direction of transportation is scheduled to arrive at the fixing member assuming that the image formation operations start again. When the re-predicted temperature of the switching element is less than the upper limit, the control unit may suspend the second control, cause the print unit to start the image formation operations, and control power supplied to the excitation coil by lifting the restriction on switching, so that by the time point B the detected temperature of the fixing member reaches the temperature necessary for fixing.

(5) In the image forming apparatus of (4), the control unit may prohibit the print unit from performing image formation operations when the re-predicted temperature of the switching element is at least the upper limit.

(6) The image forming apparatus of (2) may be capable of switching between performing the image formation operations in a first image formation mode and a second image formation mode, the image carrier may include a plurality of photoconductors and an intermediate transfer body that rotates. In the first image formation mode, the image may be formed on the image carrier by charging and exposing each of the plurality of photoconductors to form an electrostatic latent image on each of the plurality of photoconductors, developing each electrostatic latent image, and transferring a resulting image from each of the plurality of photoconductors onto the intermediate transfer body by superimposition at a primary transfer position of each of the plurality of photoconductors. In the second image formation mode, the image may be formed on the image carrier using only one photoconductor among the plurality of photoconductors by charging and exposing the one photoconductor to form an electrostatic latent image thereon, developing the electrostatic latent image, and transferring a resulting image from the one photoconductor onto the intermediate transfer body at a primary transfer position of the one photoconductor. The image may be transferred to the sheet by secondary transfer of the image on the intermediate transfer body to the sheet at a secondary transfer position of the intermediate transfer body. Letting a first time be a time, during the first image formation mode, from a start of exposure of an upstream photoconductor, located furthest upstream in a direction of rotation of the intermediate transfer body among the plurality of photoconductors, until the image on the upstream photoconductor is transferred to the intermediate transfer body and a tip of the image reaches the secondary transfer position, a second time be a time, during the second image formation mode, from a start of exposure of the one photoconductor until the image on the one photoconductor is transferred to the intermediate transfer body and a tip of the image reaches the secondary transfer position, and a third time be a time from a start of transportation of the sheet towards the secondary transfer position until the tip of the sheet in the direction of transportation reaches the secondary transfer position, when the first time>the third time>the second time, the start of the image formation operations may be defined as the start of exposure of the upstream photoconductor during the first image formation mode, and as the start of transportation of the sheet during the second image formation mode.

(7) In the image forming apparatus of (2), the image may be formed on the image carrier by charging and exposing the image carrier to form an electrostatic latent image thereon and then developing the electrostatic latent image. Letting a first time be a time from a start of exposure of the image carrier until a tip of the image on the image carrier reaches the transfer position, and a second time be a time from a start of transportation of the sheet toward the transfer position until the tip of the sheet in the direction of transportation reaches the transfer position, the start of the image formation operations may be defined as the start of exposure of the image carrier when the first time≥the second time, and as the start of transportation of the sheet when the first time<the second time.

(8) In the image forming apparatus of (1), the control unit may restrict the switching of the switching element by (a) controlling the switching so that a predetermined minimum power is supplied to the excitation coil for a predetermined time starting immediately after the first time point or (b) suspending the switching.

(9) In the image forming apparatus of (1), the calculation unit may calculate a temperature change rate of the switching element as the change in temperature of the switching element. Letting a time point a be the first time point, a time point b be the second time point, and a time point c be earlier than the time point a, the prediction unit may determine the predicted temperature of the switching element to be a temperature TmpA of the switching element at the time point b assuming that the temperature of the switching element changes from the time point a to the time point b at the temperature change rate of the switching element from the time point c to the time point a.

(10) In the image forming apparatus of (9), letting a time point d be between the time point c and the time point a, the prediction unit may calculate a temperature TmpB of the switching element at the time point b, assuming that the temperature of the switching element changes from the time point a to the time point b at the temperature change rate of the switching element from the time point d to the time point a, and determines the predicted temperature of the switching element to be a value between the temperature TmpA and the temperature TmpB.

(11) In the image forming apparatus of (10), letting an average of the temperature TmpA and the temperature TmpB be a temperature TmpC, a total amount of power provided to the excitation coil from the time point c to the time point d be Σ1, and a total amount of power provided to the excitation coil from the time point d to the time point a be Σ2, the prediction unit may determine the predicted temperature of the switching element to be one of the temperature TmpA, the temperature TmpB, and the temperature TmpC in accordance with relative magnitudes of the total amounts of power Σ1 and Σ2.

(12) In the image forming apparatus of (11), the prediction unit may acquire a surrounding temperature around the image forming apparatus and determines the predicted temperature of the switching element to be one of the temperature TmpA, the temperature TmpB, and the temperature TmpC in accordance with the surrounding temperature and the relative magnitudes of the total amounts of power Σ1 and Σ2.

(13) An image forming method according to an aspect of the present invention is for an image forming apparatus that uses a switching element to switch current flowing to an excitation coil, so that the excitation coil generates magnetic flux that causes an electromagnetic induction heating layer in a fixing member to produce heat, the heat fixing an unfixed image formed on a transported sheet to the transported sheet, the image forming method comprising the steps of: detecting a temperature of the fixing member; calculating a change in temperature of the switching element over time; determining, at a first time point, a predicted temperature of the switching element at a second time point in accordance with the change in temperature of the switching element up until the first time point, the first time point being a predetermined time before the second time point, and the second time point being a time at which a tip of the sheet in a direction of transportation is scheduled to arrive at the fixing member; and performing first control, from the first time point until the second time point, when the predicted temperature of the switching element is at least a predetermined value, the first control controlling power supplied to the excitation coil by restricting switching of the switching element and lifting the restriction, so that by the second time point the detected temperature of the fixing member reaches a temperature necessary for fixing.

(14) The image forming method of (13) may further comprise the step of performing image formation operations to form an image on an image carrier, transport a sheet to a transfer position of the image carrier, transfer the image on the image carrier to the sheet at the transfer position as the unfixed image, and transport the sheet after image transfer to the fixing member. The first time point may be earlier than a start of the image formation operations. Second control may be performed instead of the first control when the predicted temperature of the switching element is at least an upper limit that is higher than the predetermined value, the second control temporarily suspending the start of the image formation operations and restricting switching of the switching element.

(15) In the image forming method of (14), the first time point may be a predetermined time point that is a closest time point to the start of image formation operations at which the start of image formation operations is suspendable by an instruction.

(16) In the determining step of the image forming method of (14), a determination may be made at a time point A of a re-predicted temperature of the switching element at a time point B in accordance with the change in temperature of the switching element up until the time point A, the time point A being after the start of the image formation operations are temporarily suspended, and the time point B being a time at which the tip of the sheet in the direction of transportation is scheduled to arrive at the fixing member assuming that the image formation operations start again. When the re-predicted temperature of the switching element is less than the upper limit, the second control may be suspended, the image formation operations may be started, and power supplied to the excitation coil may be controlled by lifting the restriction on switching, so that by the time point B the temperature of the fixing member reaches the temperature necessary for fixing.

(17) In the image forming method of (14), the image forming apparatus may be capable of switching between performing the image formation operations in a first image formation mode and a second image formation mode. The image carrier may include a plurality of photoconductors and an intermediate transfer body that rotates. In the first image formation mode, the image may be formed on the image carrier by charging and exposing each of the plurality of photoconductors to form an electrostatic latent image on each of the plurality of photoconductors, developing each electrostatic latent image, and transferring a resulting image from each of the plurality of photoconductors onto the intermediate transfer body by superimposition at a primary transfer position of each of the plurality of photoconductors. In the second image formation mode, the image may be formed on the image carrier using only one photoconductor among the plurality of photoconductors by charging and exposing the one photoconductor to form an electrostatic latent image thereon, developing the electrostatic latent image, and transferring a resulting image from the one photoconductor onto the intermediate transfer body at a primary transfer position of the one photoconductor. The image may be transferred to the sheet by secondary transfer of the image on the intermediate transfer body to the sheet at a secondary transfer position of the intermediate transfer body. Letting a first time be a time, during the first image formation mode, from a start of exposure of an upstream photoconductor, located furthest upstream in a direction of rotation of the intermediate transfer body among the plurality of photoconductors, until the image on the upstream photoconductor is transferred to the intermediate transfer body and a tip of the image reaches the secondary transfer position, a second time be a time, during the second image formation mode, from a start of exposure of the one photoconductor until the image on the one photoconductor is transferred to the intermediate transfer body and a tip of the image reaches the secondary transfer position, and a third time be a time from a start of transportation of the sheet towards the secondary transfer position until the tip of the sheet in the direction of transportation reaches the secondary transfer position, when the first time>the third time>the second time, the start of the image formation operations may be defined as the start of exposure of the upstream photoconductor during the first image formation mode, and as the start of transportation of the sheet during the second image formation mode.

(18) In the image forming method of (14), the image may be formed on the image carrier by charging and exposing the image carrier to form an electrostatic latent image thereon and then developing the electrostatic latent image. Letting a first time be a time from a start of exposure of the image carrier until a tip of the image on the image carrier reaches the transfer position, and a second time be a time from a start of transportation of the sheet toward the transfer position until the tip of the sheet in the direction of transportation reaches the transfer position, the start of the image formation operations may be defined as the start of exposure of the image carrier when the first time≥the second time, and as the start of transportation of the sheet when the first time<the second time.

(19) In the image forming method of (13), during the first control, the switching of the switching element may be restricted by (a) controlling the switching so that a predetermined minimum power is supplied to the excitation coil for a predetermined time starting immediately after the first time point or (b) suspending the switching.

(20) In the calculating step of the image forming method of (13), a temperature change rate of the switching element may be calculated as the change in temperature of the switching element. Letting a time point a be the first time point, a time point b be the second time point, and a time point c be earlier than the time point a, in the determining step, the predicted temperature of the switching element may be determined to be a temperature TmpA of the switching element at the time point b assuming that the temperature of the switching element changes from the time point a to the time point b at the temperature change rate of the switching element from the time point c to the time point a.

Even if the temperature of the switching element at the first time point does not exceed the predetermined value, if the predicted temperature of the switching element is at least the predetermined value, the temperature will continue to rise after the first time point, so that as the second time point, the temperature of the switching element will likely become a high temperature. With this structure, switching of the switching element is restricted in order to control the temperature of the switching element from continuing to rise, thus preventing an excess rise in temperature. After the switching is restricted, the restriction is lifted, and power supplied to the excitation coil is controlled so that by the second time point the temperature of the fixing member reaches the temperature necessary for fixing. This allows for suppression of a reduction in fixity.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

The invention claimed is:

1. An image forming apparatus that uses a switching element to switch current flowing to an excitation coil, so that the excitation coil generates magnetic flux that causes an electromagnetic induction heating layer in a fixing member to produce heat, the heat fixing an unfixed image formed on a transported sheet to the transported sheet, the image forming apparatus comprising:

a detection unit configured to detect a temperature of the fixing member;

a calculation unit configured to calculate a change in temperature of the switching element over time;

a prediction unit configured to determine, at a first time point, a predicted temperature of the switching element at a second time point in accordance with the change in temperature of the switching element up until the first time point, the first time point being a predetermined time before the second time point, and the second time point being a time at which a tip of the sheet in a direction of transportation is scheduled to arrive at the fixing member; and a control unit configured to perform first control, from the first time point until the second time point, when the predicted temperature of the switching element is at least a predetermined value, the first control controlling power supplied to the excitation coil by restricting switching of the switching element and lifting the restriction, so that by the second time point the detected temperature of the fixing member reaches a temperature necessary for fixing.

2. The image forming apparatus of claim 1, further comprising a print unit configured to perform image formation operations to form an image on an image carrier, transport a sheet to a transfer position of the image carrier, transfer the image on the image carrier to the sheet at the transfer position as the unfixed image, and transport the sheet after image transfer to the fixing member, wherein the first time point is earlier than a start of the image formation operations, and the control unit is further configured to perform second control instead of the first control when the predicted temperature of the switching element is at least an upper limit that is higher than the predetermined value, the second control temporarily suspending the start of the image formation operations by the print unit and restricting switching of the switching element.

3. The image forming apparatus of claim 2, wherein the first time point is a predetermined time point that is a closest time point to the start of image formation operations at which the start of image formation operations is suspendable by an instruction to the print unit.

4. The image forming apparatus of claim 2, wherein the prediction unit is further configured to determine, at a time point A, a re-predicted temperature of the switching element at a time point B in accordance with the change in temperature of the switching element up until the time point A, the time point A being after the start of the image formation operations are temporarily suspended, and the time point B being a time at which the tip of the sheet in the direction of transportation is scheduled to arrive at the fixing member assuming that the image formation operations start again, and when the re-predicted temperature of the switching element is less than the upper limit, the control unit suspends the second control, causes the print unit to start the image formation operations, and controls power supplied to the excitation coil by lifting the restriction on switching, so that by the time point B the detected temperature of the fixing member reaches the temperature necessary for fixing.

5. The image forming apparatus of claim 4, wherein the control unit prohibits the print unit from performing image formation operations when the re-predicted temperature of the switching element is at least the upper limit.

6. The image forming apparatus of claim 2, capable of switching between performing the image formation operations in a first image formation mode and a second image formation mode, wherein the image carrier includes a plurality of photoconductors and an intermediate transfer body that rotates, in the first image formation mode, the image is formed on the image carrier by charging and exposing each of the plurality of photoconductors to form an electrostatic latent image on each of the plurality of photoconductors, developing each electrostatic latent image, and transferring a resulting image from each of the plurality of photoconductors onto the intermediate transfer body by superimposition at a primary transfer position of each of the plurality of photoconductors, in the second image formation mode, the image is formed on the image carrier using only one photoconductor among the plurality of photoconductors by charging and exposing the one photoconductor to form an electrostatic latent image thereon, developing the electrostatic latent image, and transferring a resulting image from the one photoconductor onto the intermediate transfer body at a primary transfer position of the one photoconductor, the image is transferred to the sheet by secondary transfer of the image on the intermediate transfer body to the sheet at a secondary transfer position of the intermediate transfer body, letting a first time be a time, during the first image formation mode, from a start of exposure of an upstream photoconductor, located furthest upstream in a direction of rotation of the intermediate transfer body among the plurality of photoconductors, until the image on the upstream photoconductor is transferred to the intermediate transfer body and a tip of the image reaches the secondary transfer position, a second time be a time, during the second image formation mode, from a start of exposure of the one photoconductor until the image on the one photoconductor is transferred to the intermediate transfer body and a tip of the image reaches the secondary transfer position, and a third time be a time from a start of transportation of the sheet towards the secondary transfer position until the tip of the sheet in the direction of transportation reaches the secondary transfer position, when the first time>the third time>the second time, the start of the image formation operations is defined as the start of exposure of the upstream photoconductor during the first image formation mode, and as the start of transportation of the sheet during the second image formation mode.

7. The image forming apparatus of claim 2, wherein the image is formed on the image carrier by charging and exposing the image carrier to form an electrostatic latent image thereon and then developing the electrostatic latent image, and letting a first time be a time from a start of exposure of the image carrier until a tip of the image on the image carrier reaches the transfer position, and a second time be a time from a start of transportation of the sheet toward the transfer position until the tip of the sheet in the direction of transportation reaches the transfer position, the start of the image formation operations is defined as the start of exposure of the image carrier when the first time≥the second time, and as the start of transportation of the sheet when the first time<the second time.

8. The image forming apparatus of claim 1, wherein the control unit restricts the switching of the switching element by (a) controlling the switching so that a predetermined minimum power is supplied to the excitation coil for a predetermined time starting immediately after the first time point or (b) suspending the switching.

9. The image forming apparatus of claim 1, wherein the calculation unit calculates a temperature change rate of the switching element as the change in temperature of the switching element, and letting a time point a be the first time point, a time point b be the second time point, and a time point c be earlier than the time point a, the prediction unit determines the predicted temperature of the switching element to be a temperature TmpA of the switching element at the time point b assuming that the temperature of the switching element changes from the time point a to the time point b at the temperature change rate of the switching element from the time point c to the time point a.

10. The image forming apparatus of claim 9, wherein letting a time point d be between the time point c and the time point a, the prediction unit calculates a temperature TmpB of the switching element at the time point b, assuming that the temperature of the switching element changes from the time point a to the time point b at the temperature change rate of the switching element from the time point d to the time point a, and determines the predicted temperature of the switching element to be a value between the temperature TmpA and the temperature TmpB.

11. The image forming apparatus of claim 10, wherein letting an average of the temperature TmpA and the temperature TmpB be a temperature TmpC, a total amount of power provided to the excitation coil from the time point c to the time point d be Σ1, and a total amount of power provided to the excitation coil from the time point d to the time point a be Σ2, the prediction unit determines the predicted temperature of the switching element to be one of the temperature TmpA, the temperature TmpB, and the temperature TmpC in accordance with relative magnitudes of the total amounts of power Σ1 and Σ2.

12. The image forming apparatus of claim 11, wherein the prediction unit acquires a surrounding temperature around the image forming apparatus and determines the predicted temperature of the switching element to be one of the temperature TmpA, the temperature TmpB, and the temperature TmpC in accordance with the surrounding temperature and the relative magnitudes of the total amounts of power Σ1 and Σ2.

13. An image forming method for an image forming apparatus that uses a switching element to switch current flowing to an excitation coil, so that the excitation coil generates magnetic flux that causes an electromagnetic induction heating layer in a fixing member to produce heat, the heat fixing an unfixed image formed on a transported sheet to the transported sheet, the image forming method comprising the steps of:

detecting a temperature of the fixing member;

calculating a change in temperature of the switching element over time;

determining, at a first time point, a predicted temperature of the switching element at a second time point in accordance with the change in temperature of the switching element up until the first time point, the first time point being a predetermined time before the second time point, and the second time point being a time at which a tip of the sheet in a direction of transportation is scheduled to arrive at the fixing member; and performing first control, from the first time point until the second time point, when the predicted temperature of the switching element is at least a predetermined value, the first control controlling power supplied to the excitation coil by restricting switching of the switching element and lifting the restriction, so that by the second time point the detected temperature of the fixing member reaches a temperature necessary for fixing.

14. The image forming method of claim 13, further comprising the step of:

performing image formation operations to form an image on an image carrier, transport a sheet to a transfer position of the image carrier, transfer the image on the image carrier to the sheet at the transfer position as the unfixed image, and transport the sheet after image transfer to the fixing member, wherein the first time point is earlier than a start of the image formation operations, and second control is performed instead of the first control when the predicted temperature of the switching element is at least an upper limit that is higher than the predetermined value, the second control temporarily suspending the start of the image formation operations and restricting switching of the switching element.

15. The image forming method of claim 14, wherein the first time point is a predetermined time point that is a closest time point to the start of image formation operations at which the start of image formation operations is suspendable by an instruction.

16. The image forming method of claim 14, wherein in the determining step, a determination is made at a time point A of a re-predicted temperature of the switching element at a time point B in accordance with the change in temperature of the switching element up until the time point A, the time point A being after the start of the image formation operations are temporarily suspended, and the time point B being a time at which the tip of the sheet in the direction of transportation is scheduled to arrive at the fixing member assuming that the image formation operations start again, and when the re-predicted temperature of the switching element is less than the upper limit, the second control is suspended, the image formation operations are started, and power supplied to the excitation coil is controlled by lifting the restriction on switching, so that by the time point B the temperature of the fixing member reaches the temperature necessary for fixing.

17. The image forming method of claim 14, wherein the image forming apparatus is capable of switching between performing the image formation operations in a first image formation mode and a second image formation mode, the image carrier includes a plurality of photoconductors and an intermediate transfer body that rotates, in the first image formation mode, the image is formed on the image carrier by charging and exposing each of the plurality of photoconductors to form an electrostatic latent image on each of the plurality of photoconductors, developing each electrostatic latent image, and transferring a resulting image from each of the plurality of photoconductors onto the intermediate transfer body by superimposition at a primary transfer position of each of the plurality of photoconductors, in the second image formation mode, the image is formed on the image carrier using only one photoconductor among the plurality of photoconductors by charging and exposing the one photoconductor to form an electrostatic latent image thereon, developing the electrostatic latent image, and transferring a resulting image from the one photoconductor onto the intermediate transfer body at a primary transfer position of the one photoconductor, the image is transferred to the sheet by secondary transfer of the image on the intermediate transfer body to the sheet at a secondary transfer position of the intermediate transfer body, letting a first time be a time, during the first image formation mode, from a start of exposure of an upstream photoconductor, located furthest upstream in a direction of rotation of the intermediate transfer body among the plurality of photoconductors, until the image on the upstream photoconductor is transferred to the intermediate transfer body and a tip of the image reaches the secondary transfer position, a second time be a time, during the second image formation mode, from a start of exposure of the one photoconductor until the image on the one photoconductor is transferred to the intermediate transfer body and a tip of the image reaches the secondary transfer position, and a third time be a time from a start of transportation of the sheet towards the secondary transfer position until the tip of the sheet in the direction of transportation reaches the secondary transfer position, when the first time>the third time>the second time, the start of the image formation operations is defined as the start of exposure of the upstream photoconductor during the first image formation mode, and as the start of transportation of the sheet during the second image formation mode.

18. The image forming method of claim 14, wherein the image is formed on the image carrier by charging and exposing the image carrier to form an electrostatic latent image thereon and then developing the electrostatic latent image, and letting a first time be a time from a start of exposure of the image carrier until a tip of the image on the image carrier reaches the transfer position, and a second time be a time from a start of transportation of the sheet toward the transfer position until the tip of the sheet in the direction of transportation reaches the transfer position, the start of the image formation operations is defined as the start of exposure of the image carrier when the first time≥the second time, and as the start of transportation of the sheet when the first time<the second time.

19. The image forming method of claim 13, wherein during the first control, the switching of the switching element is restricted by (a) controlling the switching so that a predetermined minimum power is supplied to the excitation coil for a predetermined time starting immediately after the first time point or (b) suspending the switching.

20. The image forming method of claim 13, wherein in the calculating step, a temperature change rate of the switching element is calculated as the change in temperature of the switching element, and letting a time point a be the first time point, a time point b be the second time point, and a time point c be earlier than the time point a, in the determining step, the predicted temperature of the switching element is determined to be a temperature TmpA of the switching element at the time point b assuming that the temperature of the switching element changes from the time point a to the time point b at the temperature change rate of the switching element from the time point c to the time point a.

* * * * *